US007418229B2

(12) United States Patent
Aruga et al.

(10) Patent No.: US 7,418,229 B2
(45) Date of Patent: Aug. 26, 2008

(54) FUSING UNIT THAT STABILIZES A CONTACT NIP REGION

(75) Inventors: Tomoe Aruga, Nagano (JP); Ken Ikuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 288 days.

(21) Appl. No.: 11/291,108

(22) Filed: Nov. 29, 2005

(65) Prior Publication Data

US 2006/0147231 A1 Jul. 6, 2006

(30) Foreign Application Priority Data

Nov. 29, 2004 (JP) ..... P2004-343531
Nov. 29, 2004 (JP) ..... P2004-343532

(51) Int. Cl.
*G03G 15/20* (2006.01)

(52) U.S. Cl. ..... 399/329

(58) Field of Classification Search ..... 399/329, 399/328

See application file for complete search history.

(56) References Cited

U.S. PATENT DOCUMENTS 5,729,812 A 3/1998 Moser
6,643,490 B2 * 11/2003 Regimbal ..... 399/329
6,975,829 B2 * 12/2005 Aruga ..... 399/329
7,024,145 B2 * 4/2006 Aruga et al. ..... 399/329
7,194,233 B2 * 3/2007 Wu et al. ..... 399/329
2004/0033092 A1 * 2/2004 Aruga ..... 399/329
2005/0141914 A1 * 6/2005 Hiraoka et al.
2006/0013625 A1 * 1/2006 Aruga et al. ..... 399/329

FOREIGN PATENT DOCUMENTS

EP 1 367 461 A2 12/2003
JP 59-188673 10/1984
JP 3084692 6/1993
JP 3480250 1/1999
JP 2004-004234 1/2004
JP 2004020899 A * 1/2004

* cited by examiner

*Primary Examiner*—Susan S Lee
(74) *Attorney, Agent, or Firm*—Hogan & Hartson LLP

(57) ABSTRACT

A fusing unit for fusing a nonfused toner image formed on a sheet medium, including: a heating roller; a pressing roller pressed to the heating roller; a heat-resistant belt which is wrapped around an outer periphery of the pressing roller and travels while being nipped at a nip portion between the pressing roller and the heating roller; a belt stretching member which stretches the heat-resistant belt; and a sliding member which is disposed between the belt stretching member and the pressing roller and slides along the outer periphery of the pressing roller, wherein the sliding member is disposed to be brought into contact with the heating roller through the heat-resistant belt at a contact portion.

25 Claims, 13 Drawing Sheets

FUSING UNIT THAT STABILIZES A CONTACT NIP REGION

BACKGROUND OF THE INVENTION

1. Technical Field of the Invention

The present invention relates to a fusing unit which fuses an nonfused toner image formed on a sheet medium and includes a heating roller, a pressing roller pressed to the heating roller, a heat-resistant belt which is wrapped around an outer periphery of the pressing roller and travels while being nipped between the heating roller and the pressing roller, and a belt stretching member for stretching the heat-resistant belt and an image forming apparatus.

2. Description of the Related Art

The following two types of fusing devices have been proposed as a heating-roller-type fusing device which is mounted on an image forming apparatus such as a copier, a printer, or a facsimile and which fuses a nonfused toner image on a transfer material through contact thermofusing. Namely, one type of fusing device comprises a heating roller whose surface is coated with an elastic body and which has a built-in heat source and is capable of rotating; an endless heat-resistant belt stretched by a plurality of support rollers; and a pressing member which wraps the heat-resistant belt around the heating roller over only a predetermined angle to thus form a nipping portion and which locally applies pressure, which is greater than that applied to the other areas, to the heat-resistant belt at an exit of the nipping portion, to thus cause distortion in the elastic body on the surface of the heating roller. The fusing device facilitates output of the sheet medium from the nipping portion (see, e.g., Japanese Patent No. 3084692). The other type of fusing device has a pressing member which has a projecting section and is provided at the inside of the endless heat-resistant belt, thereby decreasing a minute pressure area in the nipping portion (see, e.g., Japanese Patent No. 3480250).

The fusing devices require a plurality of support rollers and rotary bearings thereof. This renders the fusing device expensive as well as complicated and bulky; and inevitably makes an image forming apparatus equipped with the fusing device complicated, bulky, and expensive. Further, when the circumference of the heat-resistant belt becomes longer and the belt is moved over a predetermined path, the heat-resistant belt is deprived of thermal energy by a plurality of support rollers, and the amount of naturally-dissipated heat is increased in accordance with the circumference. Accordingly, a longer time must be consumed before the temperature of the heat-resistant belt reaches a predetermined level. This undesirably entails a longer so-called warm-up time which elapses from when power is turned on until fusing becomes feasible.

The heat-resistant belt is wrapped around the heating roller over only an angle which enables formation of a nipping portion, and pressure which is greater than that applied to the other areas is locally applied to the heat-resistant belt at the exit of the nipping portion, to thus cause distortion in the elastic layer of the heating roller. This configuration is suitable for preventing the sheet medium from wrapping around the heating roller. However, the sheet medium output along the distortion of the elastic layer is curled in imitation of this distortion or is subjected to deformation, such as occurrence of wrinkles, caused by local high pressure.

In addition to these fusing devices, another fusing device (see, e.g., Japanese Patent Publication No. 6-40235B) has also been proposed. The device deforms rollers by the pressure set between the rollers, to thus form a nipping length over which a sheet medium is to contact the rollers. A sheet medium carrying a nonfused toner image is caused to pass through the nipping portion, thereby fusing the toner image. The rollers are driven by selecting a first speed or a second speed as a drive speed of the rollers in accordance with characteristics of the sheet medium. However, the heat capacity of the rollers is large, and, hence, consumption of a long warm-up time is undesirably required. In addition, the sheet medium, having passed through the long nipping portion formed by deforming the rollers with pressure, undergoes stress derived from the pressure, as in the case of the former fusing device, which in turn causes deformation of the sheet medium, such as occurrence of a curl or wrinkles.

Still another fusing device (see, e.g., Japanese Patent Publication No. 2004-4235A) has been proposed as a device which solves the above-described drawbacks. A stretching member is placed at a position which is upstream with respect to the moving direction of a heat-resistant belt and where the heat-resistant belt turns itself around a heating roller to thus form a nipping portion, with reference to a tangential line of a press contact position defined between the heating roller and a pressing roller. This stretching member is supported so as to be swayable. As a result, the structure of the heat-roller-type fusing device can be subjected to simplification, downsizing, and cost-saving. A warm-up time can be shortened, and deformation of an output sheet medium, such as occurrence of a curl or wrinkles in the sheet medium, can be prevented by reducing stress imposed on the sheet medium.

The structures of the respective related-art fusing devices that have been proposed thus far are effective means for enhancing the fusing characteristic. However, the structures are not sufficient for forming a stable nipping portion in the axial direction of the heating roller and that of the pressing roller; namely, over the entire longitudinal area of the heating roller and that of the pressing roller. More specifically, the nipping portion is slightly relevant to axial deflection of the heating roller and that of the pressing roller attributable to pressure or deformation of the pressing member or that of the stretching member, such as a twist, a warpage, or an axial torsion. For these reasons, under the present circumstances, the nipping portion is under influence of such deformation, and difficulty is encountered in preventing the nipping portion from becoming unstable. Thus, enhancement of the fusing characteristic cannot be achieved.

In addition, there may arise a case where creeping deformation arises under influence of the heating roller which is heated to a temperature as high as about 200° C. Particularly, when the stretcher is formed from a plastic material having low thermal capacity, on the assumption that the stretcher is effective for shortening a warm-up time, the phenomenon of occurrence of deflection or deformation has become noticeable, which is not preferable for forming a stable nipping portion.

SUMMARY OF THE INVENTION

The invention resolves the above-described problem and enhances a fusing property by enabling to form a uniform and stable fusing nip by stabilizing a contact nip region forming a nip by wrapping a heat-resistant belt to a heating roller from a tangential line of a pressing portion formed from the heating roller and a pressing roller with a simple structure. The object of the invention is achieved by the following items.

(1). A fusing unit for fusing a nonfused toner image formed on a sheet medium, comprising:

a heating roller;

a pressing roller pressed to the heating roller;

a heat-resistant belt which is wrapped around an outer periphery of the pressing roller and travels while being nipped at a nip portion between the pressing roller and the heating roller;

a belt stretching member which stretches the heat-resistant belt; and a sliding member which is disposed between the belt stretching member and the pressing roller and slides along the outer periphery of the pressing roller, wherein the sliding member is disposed to be brought into contact with the heating roller through the heat-resistant belt at a contact portion.

(2). The fusing unit according to (1), wherein the belt stretching member and the sliding member are disposed to be brought into contact with the heating roller at each contact portion through the heat-resistant belt.

(3). The fusing unit according to (2), wherein the belt stretching member is pivotably supported at the side of the heating roller with an edge portion on the back side of the sliding member as a supporting point.

(4). The fusing unit according to (2), wherein the contact portion of the belt stretching member has a flat face.

(5). The fusing unit according to (2), wherein the belt stretching member comprises a plurality of slits orthogonal to the axial direction at a portion except the contact portion thereof.

(6). The fusing unit according to (2), wherein the belt stretching member comprises a pressing portion that presses the sliding member in the direction of the heating roller on a back side of the contact portion of the sliding member.

(7). The fusing unit according to (2), wherein the sliding member comprises a sliding portion which slides along the outer periphery of the pressing roller, the sliding portion having: a plurality of projected portions in the shape of a circular arc which is formed along the outer periphery of the pressing roller and disposed in the axial direction; and a sliding face integrally formed continuously in the axial direction at a front end on the side of the nip portion.

(8). The fusing unit according to (2), wherein the contact portion of the sliding member has a curved face corresponding to a radius of curvature of the heating roller.

(9). The fusing unit according to (2), wherein the sliding member is integrally formed on the side of the nip portion and has a notched portion on the opposite side to the nip portion.

(10). The fusing unit according to (2), wherein the sliding member has a front end in a wedge-like shape to bite the nip portion by a friction force generated with rotation of the pressing roller.

(11). The fusing unit according to (2), wherein the fusing unit further comprises an urging member between the sliding member and the belt stretching member which urges the belt stretching member in a stretching direction by applying a tension to the heat-resistant belt while pressing the sliding member to the outer periphery of the pressing roller.

(12). The fusing unit according to (11), wherein a plurality of pieces of the urging member are disposed in the axial direction at a predetermined interval.

(13). The fusing unit according to (2), wherein the fusing unit further comprises an urging member that urges the sliding member in the direction of the heating roller.

(14). The fusing unit according to (2), wherein the fusing unit further comprises an urging member that urges the belt stretching member in the direction of the heating roller.

(15). An image forming apparatus comprising the fusing unit according to (2) mounted thereon.

(16). The fusing unit according to (1), wherein the belt stretching member is disposed at a position where the sheet medium is guided to the nip portion to be brought in noncontact with the heating roller through the heat-resistant belt when the sheet medium goes into the nip portion.

(17). The fusing unit according to (16), wherein the belt stretching member comprises a pressing portion that presses the sliding member in the direction of the heating roller on a back side of the contact portion of the sliding member (18). The fusing unit according to (17), wherein the pressing portion comprises an integral wall and a plurality of projected portions on the integral wall.

(19). The fusing unit according to (16), wherein the sliding member comprises a sliding portion which slides along the outer periphery of the pressing roller, the sliding portion having: a plurality of projected portions in the shape of a circular arc which is formed along the outer periphery of the pressing roller and disposed in the axial direction; and a sliding face integrally formed continuously in the axial direction at a front end on the side of the nip portion.

(20). The fusing unit according to (16), wherein the contact portion of the sliding member has a curved face corresponding to a radius of curvature of the heating roller.

(21). The fusing unit according to (16), wherein the sliding member is integrally formed on the side of the nip portion and is provided with a notched portion on the opposite side to the nip portion.

(22). The fusing unit according to (16), wherein the sliding member has a front end in a wedge-like shape to bite the nip portion by a friction force generated with rotation of the pressing roller.

(23). The fusing unit according to (16), wherein the fusing unit further comprises an urging member between the sliding member and the belt stretching member which urges the belt stretching member in a stretching direction by applying a tension to the heat-resistant belt while pressing the sliding member to the outer periphery of the pressing roller.

(24). The fusing unit according to (23), wherein a plurality of pieces of the urging member are disposed in the axial direction at a predetermined interval.

(25). The fusing unit according to (16), wherein the fusing unit further comprises an urging member that urges the sliding member in the direction of the heating roller.

(26). The fusing unit according to (16), the fusing unit further comprises an urging member that urges the belt stretching member in the direction of the heating roller.

(27). An image forming apparatus comprising the fusing unit according to (16) mounted thereon.

According to a first embodiment of the invention in which the sliding member is disposed between the belt stretching member and the pressing roller and slides along the periphery of the pressing roller, and the belt stretcher and the sliding member are brought into contact with the heating roller through the heat-resistant belt, the axial distortion of the belt stretching member and creep deformation can be prevented and a uniform and stable fusing nip is formed over the all axial direction.

According to a second embodiment of the invention in which the sliding member is disposed between the belt stretching member and the pressing roller and slides along the periphery of the pressing roller to be brought into contact with the heating roller, and the belt stretching member is disposed at a position where the sheet medium is guided to a nip portion to be brought in noncontact with the heating roller through the heat-resistant belt in advancing the sheet medium, a stable and uniform nip can be formed over an entire face in an axial direction, an introducing port portion in which the sheet medium is smoothly advanced can be formed, and the sheet medium S can advance smoothly. Accordingly, it is prevented that a sheet medium S is not advanced smoothly and is fused in a state where a front end of the sheet medium S is folded for the reason why the fusing pressure is large at the initial position where the sheet medium S goes into the fusing nip.

Additionally, according to the invention, the belt stretching member is subjected to a force corresponding to the urging force of the spring and the tension is applied to the heat-resistant belt, a force of rotating the pressing roller is as well transmitted to the nip pressing member by a friction force between the pressing roller and the sliding face, the heat-resistant belt can be pressed to the heating roller by the pressing portion and therefore, at a middle portion between a portion of pressing the belt stretching member to the heating roller and a portion of pressing the pressing roller to the heating roller, the heat-resistant belt is made to be wrapped around the heating roller and the fusing nip continuous with the pressed state can be formed.

BRIEF DESCRIPTION OF THE INVENTION

DETAILED DESCRIPTION OF THE INVENTION

Figure 1A:
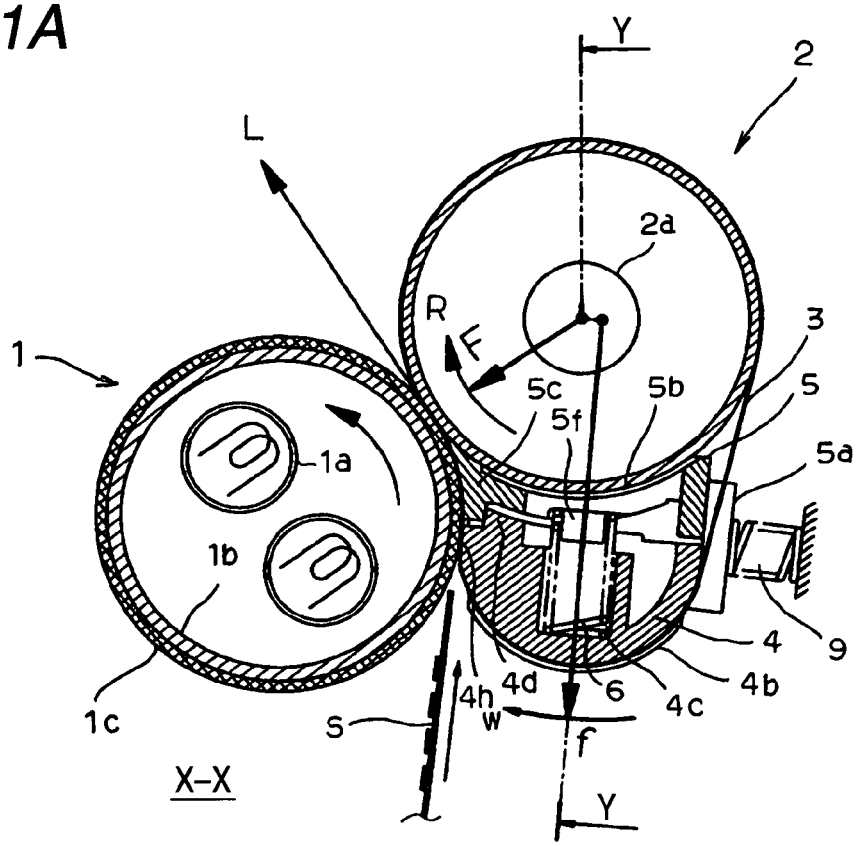
FIG. 1 illustrates views for explaining a first embodiment of a fusing unit of the invention.
Figure 1B:
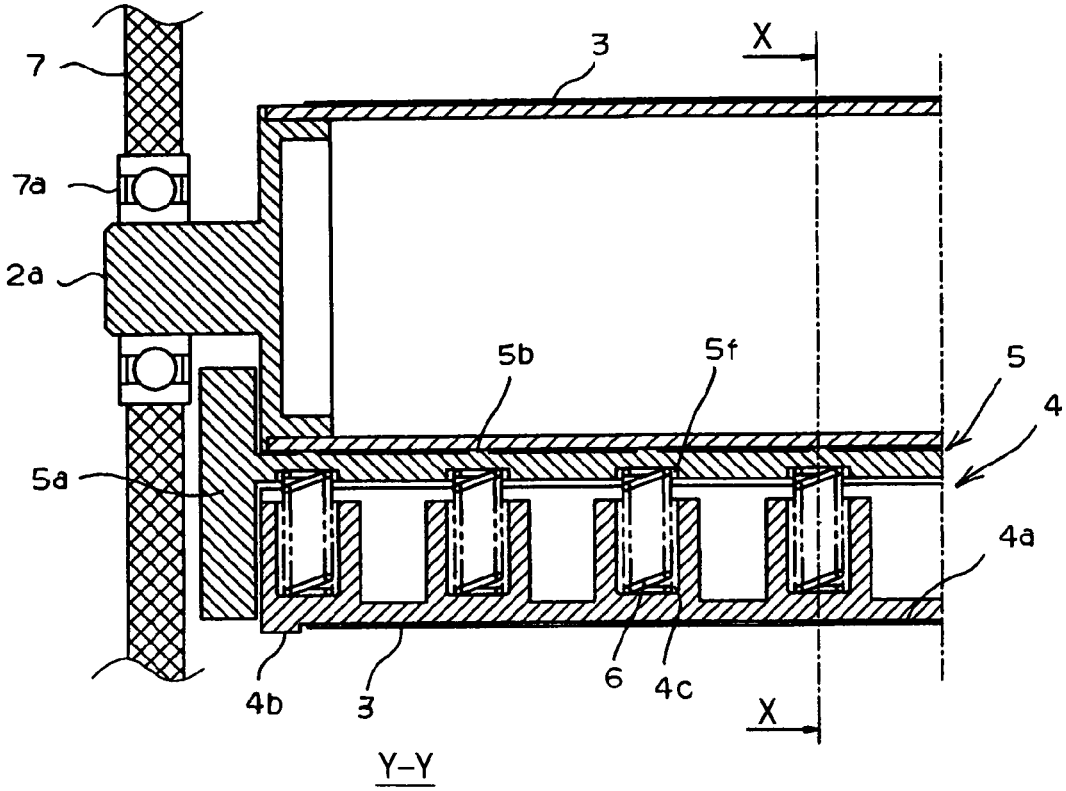
Figure 2:
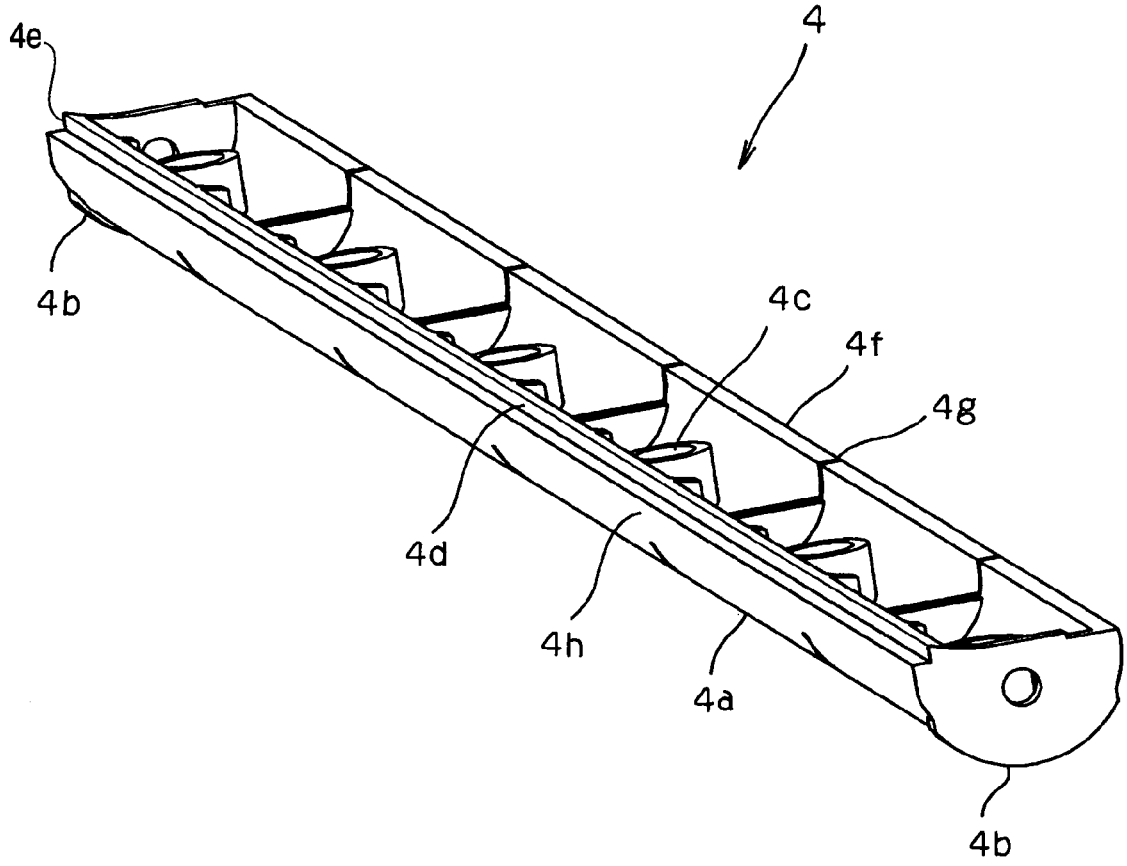
FIG. 2 is a perspective view viewed from the side of a pressing roller of a belt stretching member of the fusing unit shown in FIG. 1.
Figure 3:
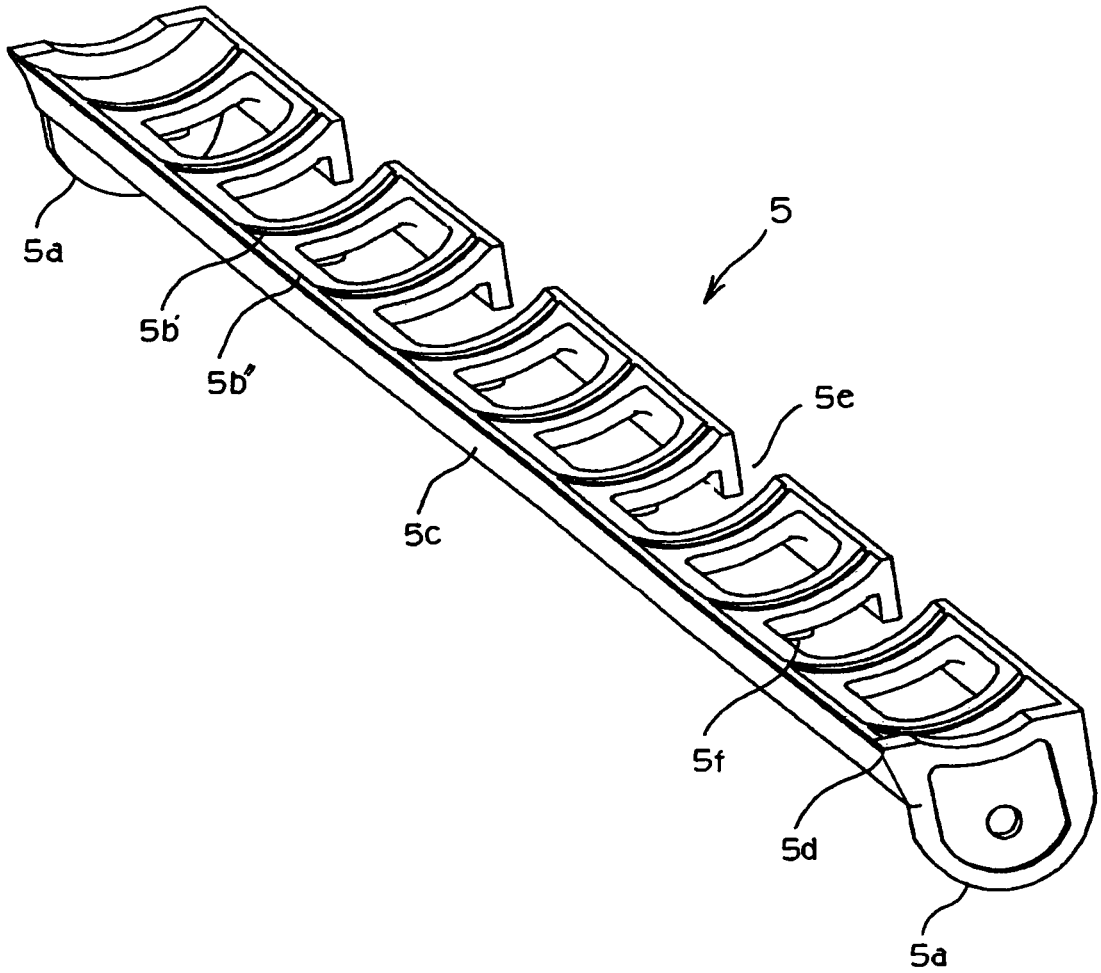
FIG. 3 is a perspective view viewed from the side of a pressing roller of a nip pressing member of the fusing unit shown in FIG. 1.
Figure 4:
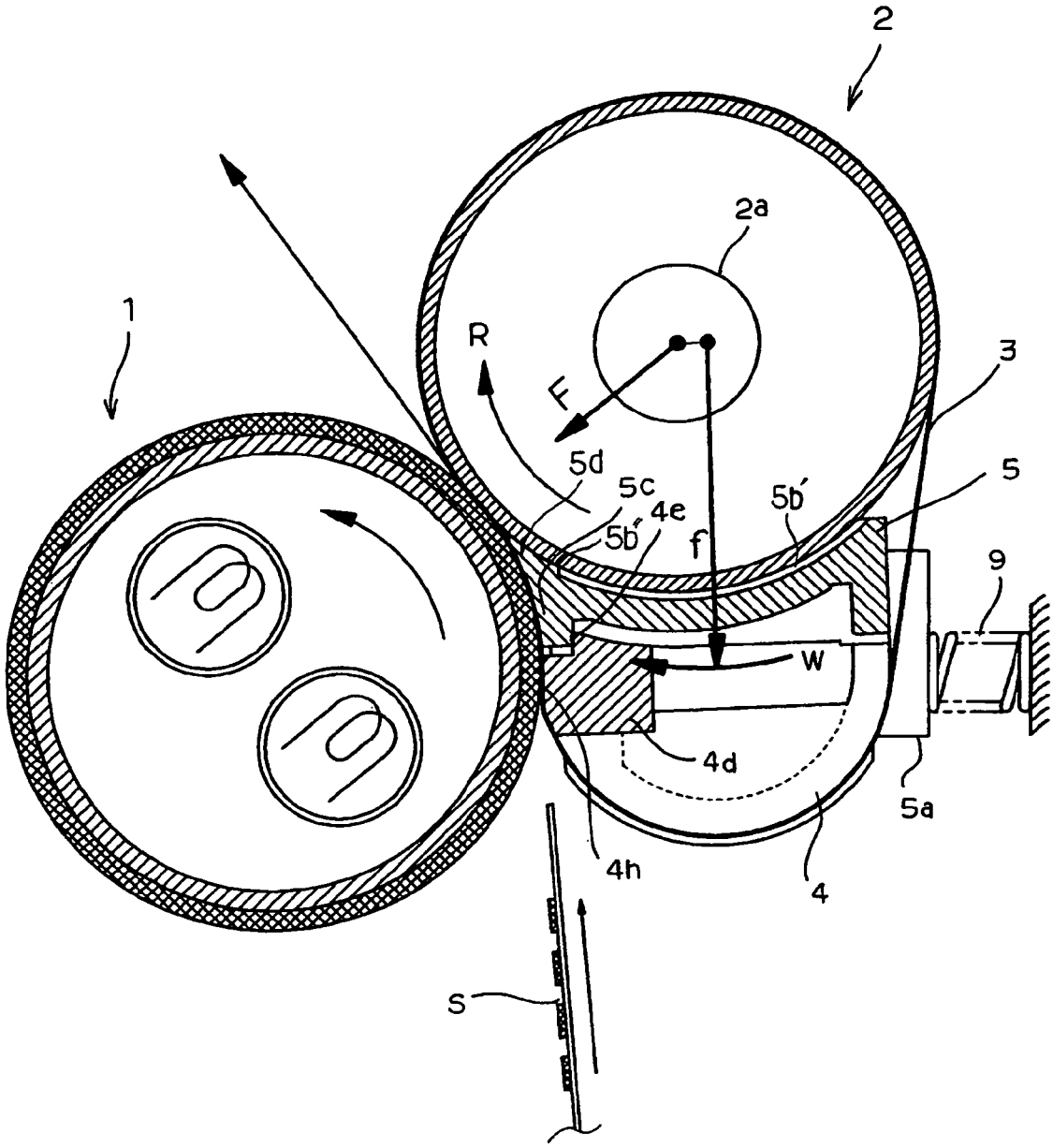
FIG. 4 is a view enlarging to show a fusing nip portion of the fusing unit shown in FIG. 1.

A first embodiment of the invention will be explained in reference to the drawings as follows. FIG. 1 shows an embodiment of a fusing unit according to the invention, FIG. 1(A) is a sectional view taken along a line X-X of FIG. 1(B) and viewed in an arrow direction, and FIG. 1(B) is a sectional view taken along a line Y-Y of FIG. 1(A), in which a right half of the apparatus is omitted. FIG. 2 is a perspective view of a belt stretching member of the fusing unit shown in FIG. 1 viewed from the side of a pressing roller thereof, FIG. 3 is a perspective view of a nip pressing member of the fusing unit shown in FIG. 1 viewed from the side of the pressing roller, and FIG. 4 is a view enlarging to show a fusing nip portion of the fusing unit shown in FIG. 1. In the drawings, numeral 1 designates a heating roller, numeral 2 designates a pressing roller, numeral 3 designates a heat-resistant belt, numeral 4 designates a belt stretching member, notation 4*a* designates a belt sliding face, notation 4*b* designates a projected wall, notation 4*c* designates a spring receive portion, notation 4*d* designates an integral wall portion, notation 4*e* designates a pressing portion, notation 4*f* designates a wall portion, notation 4*g* designates an opening portion, notation 4*h* designates a flat face, numeral 5 designates a nip pressing member, notation 5*a* designates a flange, notation 5*b* designates a sliding contact portion, notation 5*c* designates a pressing portion, notation 5*d* designates a front end, notation 5*e* designates a notched portion, notation 5*f* designates a spring arranging portion (hole), numeral 6, 9 designate springs and numeral 7 designates a frame.

In FIG. 1, A heating roller 1 is formed by coating the outer peripheral face of a pipe material with an elastic body 1*c* having a thickness of 0.4 mm or thereabouts. The pipe material has an outer diameter of about 25 mm and a thickness of about 0.7 mm and is taken as the roller base material 1*b*. The heating roller 1 incorporates as the heat sources two columnar halogen lamps 1*a*, each consuming electric power of 1050 watts. A pressing roller 2 is formed by coating an outer peripheral face of a pipe material with an elastic material having a thickness of about 0.2 mm. The material has, e.g., an outer diameter of about 25 mm and a thickness of about 0.7, mm and is taken as a roller base material. The pressing roller 2 is configured such that compression force arising between the heating roller 1 and the pressing roller 2 assumes a value of 10 kg or less and such that a nipping length assumes a value of about 10 mm. The pressing roller 2 is disposed opposite the heating roller 1 and is rotatable in the direction of the illustrated arrow R. Rotating shafts 2*a* at both ends of the pressing roller 2 are rotatably supported by the left and right frames 7 via bearings 7*a* as shown in FIG. 1(B).

The heat-resistant belt 3 is an endless belt which is nipped between the heating roller 1 and the pressing roller 2 and made movable while being stretched around the outer peripheral face of the pressing roller 2 and that of a belt stretching member 4. The heat-resistant belt is formed from, e.g., a metal tube having a thickness of about 0.03 mm or more, such as a stainless steel tube or an electro-galvanized nickel tube, or a heat-resistant resin tube such as polyimide or silicon.

The belt stretching member 4 is a sliding member (the heat-resistant belt 3 is a member sliding on the belt stretching member 4) which is substantially in the shape of a half moon and insertingly fitted to an inner periphery of the heat-resistant belt 3 for applying a tension "f" to the heat-resistant belt between the belt stretching member 4 and the pressing roller 2. The belt stretching member 4 is disposed at a position where a nip is formed by wrapping the heat-resistant belt 3 around the heating roller 1 on the upstream side of the nipping portion of the heating roller 1 and the pressing roller 2, with respect to the transporting direction of the sheet medium S. Moreover, the belt stretching member 4 is disposed so as to be pivotable in the direction of arrow W around the rotary shaft 2*a* of the pressing roller 2. The stretcher 4 is configured such that the belt 3 is stretched in the tangential direction of the heating roller 1 while the sheet medium S does not pass through the nipping portion.

The nip pressing member 5 is a sliding member sliding on the pressing roller 2 and includes the sliding contact portion 5*b* which is brought into sliding contact with the pressing roller 2 along an outer periphery thereof and the pressing portion 5*c* for pressing the heat-resistant belt 3 to the heating roller 1 on an upstream side of the nip portion. The nip pressing member 5 is urged by a spring slightly in a direction of the pressing roller 2. Thus a friction force is imparted along the outer periphery of the pressing roller 2 with rotation of the heating roller 2, the nip pressing member 5 slides, and the pressing portion 5*c* presses the heating roller 1 through the heat-resistant belt 3. As a result, a front end of the pressing portion 5*c* is made to bite the nip portion.

As shown in FIG. 2, the belt stretching member 4 includes the projected wall(s) 4*b* for restricting meandering of the heat-resistant belt 3 at both ends or one end of the belt sliding face 4*a* and includes the spring receive portion 4*c* at a position on a back side of the belt sliding face 4*a* opposed to the spring arranging portion 5*f* of the nip pressing member 5, mentioned later. Further, the belt stretching member 4 is disposed such that the pressing portion 4*e* is brought into contact with and presses an edge portion at a wall face on a back side of the pressing portion 5*c* of the nip pressing member 5 and pivoted to the side of the heating roller 1 by constituting a pivoting fulcrum by the edge portion to press the heat-resistant belt 3 to the heating roller 1. A relative positional relationship between the belt stretching member 4 and the heating roller 1 is determined in a state where the heat-resistant belt 3 is stretched on the pressing roller 2 and the belt stretching member 4 to apply the tension, and in a fine relationship, the relationship may be a relative relationship where the belt stretching member 4 is not in parallel with the heating roller 1 in an axial direction, so-called skewed therefrom, or the belt stretching member 4 is influenced by a straightness of warp, bending or the like of the belt stretching member 4. In that case, when a portion where the belt stretching member 4 lightly presses the heating roller 1 from the inner side of the heat-resistant belt 3 is formed to be a curved face in a cylindrical shape, there is a case in which a behavior of the fusing nip at a position where the belt stretching member 4 lightly presses the heating roller 1 from the inner side of the heat-resistant belt 3 cannot be formed uniformly. However, when the portion where the belt stretching member 4 lightly presses the heating roller 1 from the inner side of the heat-resistant belt 3 is formed to be the flat face 4*h*, a nonuniform state of the fusing nip at the portion can be alleviated and a preferable fusing nip can easily be formed.

Further, when the stable nip is formed at the portion where the belt stretching member 4 lightly presses, a sliding friction force between the heat-resistant belt 3 and the belt stretching member 4 is added corresponding to a sliding friction force generated from the tension of the heat-resistant belt 3. Thereby, when the heat-resistant belt 3 is driven by the pressing roller 2, at a middle region of the portion where the belt stretching member 4 lightly presses the heating roller 1 and the portion where the pressing roller 2 lightly presses the heating roller 1 (a middle region of the fusing nip), there can be formed the fusing nip continuously in a pressed state in which the heat-resistant belt 3 is made to be wrapped on the heating roller 1 by the curved face of the pressing portion 5*c* of the nip pressing member 5.

As shown in FIG. 3, the nip pressing member 5 constitutes a guide portion in which the flanges 5*a* are formed at the both ends thereof to extend to both end faces of the pressing roller 2 and the belt stretching member 4. The flanges 5*a* guides the pressing roller 2 and the belt stretching member 4 while being in contact with the both ends faces. A contact portion of the guide portion which is brought into contact with the end faces of the pressing roller 2 and the belt stretching member 4 may not be a face brought into sliding contact therewith, but may be a plurality of projections, or a ball or a roller brought into pivoting contact therewith, or the portion may be not provided at the nip pressing member 5 but may be provided at a counter side thereof. Further, the nip pressing member 5 constitutes a plurality of circular arc shape projected portions 5*b*' disposed substantially at an equal interval in an axial direction and brought into sliding contact with the pressing roller 2 along an outer periphery thereof and a sliding contact face 5*b*" an entire face of which is brought into sliding contact with the pressing roller 2 continuously in an axial direction at a front end on the side of the nip portion as the sliding contact portion 5*b* at an inner face thereof, and includes a curved face in correspondence with a radius of curvature of the heating roller 1 including a thickness of the heat-resistant belt 3 for pressing the heat-resistant belt 3 to the heating roller 1 by a constant width in an axial direction as the pressing portion 5*c* at a side face thereof. Further, the pressing portion 4*e* having a projected shape of the belt stretching member 4 is brought into contact with a face on a back side of the pressing portion 5*c*.

In this way, as shown in FIG. 1 and FIG. 4, the front end 5*d* of the nip pressing member 5 is formed to be an acute angle in a wedge-like shape by a predetermined radius of curvature by projecting and extending the front end 5*d*, the sliding contact face 5*b*" is brought into sliding contact with the outer periphery of the pressing roller 2 over an entire face in an axial direction by a constant width, and the pressing portion 5*c* is pressed to the heating roller 1 over an entire face in an axial direction via the heat-resistant belt 3 to bite the nip portion of the heating roller 1 and the pressing roller 2. Thereby, even when a rigidity is reduced, deformation of the shape is restricted by the heating roller 1 and the pressing roller 2 and therefore, even when a member made of a plastic material or the like having a low rigidity in which the heat capacity is small to be effective in shortening a warming up time period is used, a desired stable shape can be maintained by preventing contact of the nip portion from being unstable by a deficiency in the rigidity or thermal deformation of the front end 5*d*, a sufficient pressing force of the nip can be ensured even at the front end 5*d* and thin-size and light-weighted formation can be achieved. Further, by providing the notched portion 5*e* at a portion other than the nip portion of the nip pressing member 5, that is, a portion on a side opposed to the side of the heating roller 1 to form a discontinuous and opened portion, even when the nip pressing member 5 is heated from the side of the heating roller 1 to produce a temperature difference from the opposed side, the nip pressing member 5 can be prevented from being deformed by producing warp by a difference in thermal expansion.

Further, according to the embodiment, the nip pressing member 5 is formed with the spring arranging portion (hole) 5*f* on a back side of the sliding contact portion 5*b* and the spring arranging portion 5*f* is disposed with the spring 6 between the spring arranging portion 5*f* and the belt stretching member 4. Further, as shown in FIG. 1(B), the end face of the pressing roller 2 and the flange 5*a* are brought into contact with each other by constituting the guide portion by the flange 5*a*, the pressing roller 2 and the belt stretching member 4 are disposed to be disposed between the flanges 5*a* of the nip pressing member 5, and the nip pressing member 5 and the belt stretching member 4 are positioned relative to the pressing roller 2. By the constitution, the tension in accordance with urge forces of the respective springs 6 is imparted to the belt stretching member 4, and the tension f is applied to the heat-resistant belt 3. At the same time, a force of pivoting the pressing roller 2 is transmitted to the nip pressing member 5 by the friction force between the pressing roller 2 and the sliding contact portion 5*b*, and the heat-resistant belt 3 can be pressed to the heating roller 1 by way of the pressing portion 5*c*.

Further, in accordance with driving the heat-resistant belt 3, by the friction force between the heat-resistant belt 3 and the belt sliding face 4*a*, the belt stretching member 4 is urged to pivot to the side of the heating roller 1, the projected shape pressing portion 4*e* presses the back side of the pressing portion 5*c* of the nip pressing member 5 and therefore, the pressing force of the pressing portion 5*c* is applied thereto. Further, as shown in FIG. 1(B) and FIG. 4, when the urge force by the spring 9 is imparted to the flange 5*a* in the direction of the arrow W, the pressing force of the pressing portion 5*c* can further be increased.

Figure 5:
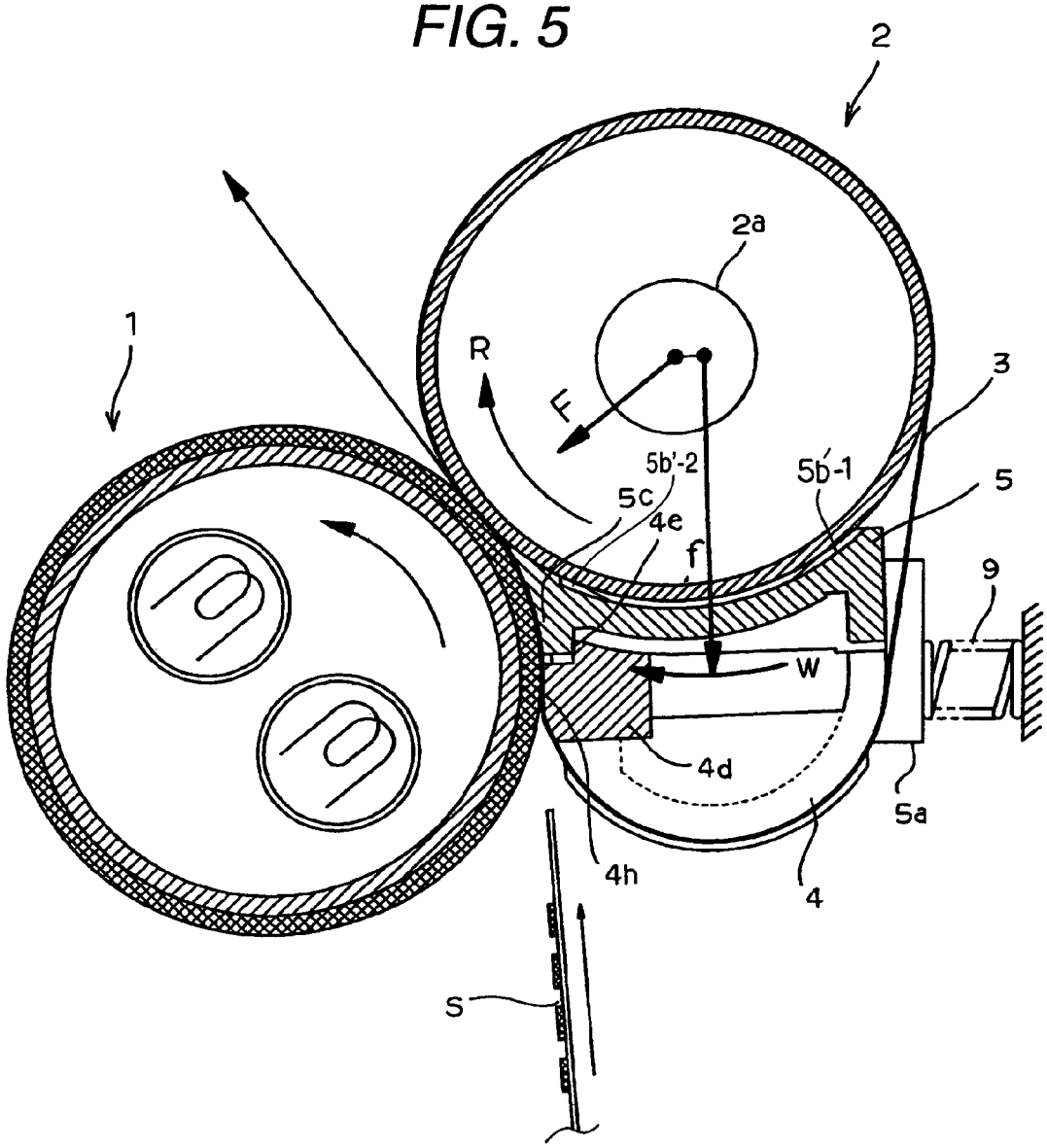
FIG. 5 is a view showing a modified example of the fusing unit shown in FIG. 1.
Figure 6:
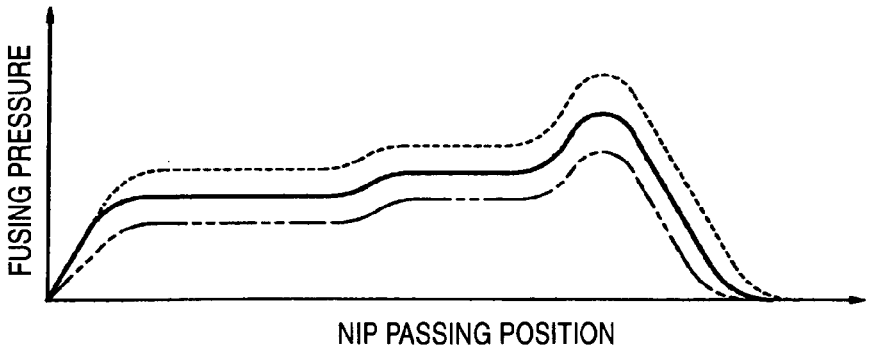
FIG. 6 is a diagram showing a nip passing position and variations in a fusing pressure.

FIG. 5 shows a sectional shape showing a modified example of the fusing unit of FIG. 1. FIG. 6 is a diagram showing a nip passing position and variations in the fusing pressure. In FIG. 1, the inner face of the nip pressing member 5 is formed to have the sliding contact portion 5*b* in the projected shape whose curvature radius is substantially the same as that of the outer peripheral face of the pressing roller 2 and is disposed to be brought into sliding contact with the pressing roller 2. However, according to an embodiment shown in FIG. 5, the sliding contact portion 5*b* brings the nip pressing member 5 into sliding contact therewith by a synthesized force of vectors at two positions 5*b*'-1, 5*b*'-2 along the outer peripheral face of the pressing roller 2.

As shown in FIG. 6, in general, a difference arises in the fusing pressure according to the thickness of the sheet medium. However, the fusing pressure becomes higher at the position where the nip pressing member 5 presses than from a nipping start position to the position where the belt stretching member 4 presses, and much higher at a nipping end position, thereby realizing forming a more stable nipping. Additionally, dashed lines denote variations in fusing pressure achieved in the case of a thick sheet medium; solid lines denote variations in fusing pressure achieved in the case of a sheet medium having a standard thickness; and dashed chain lines denote variations in fusing pressure achieved in the case of a thin sheet medium.

Figure 7A:
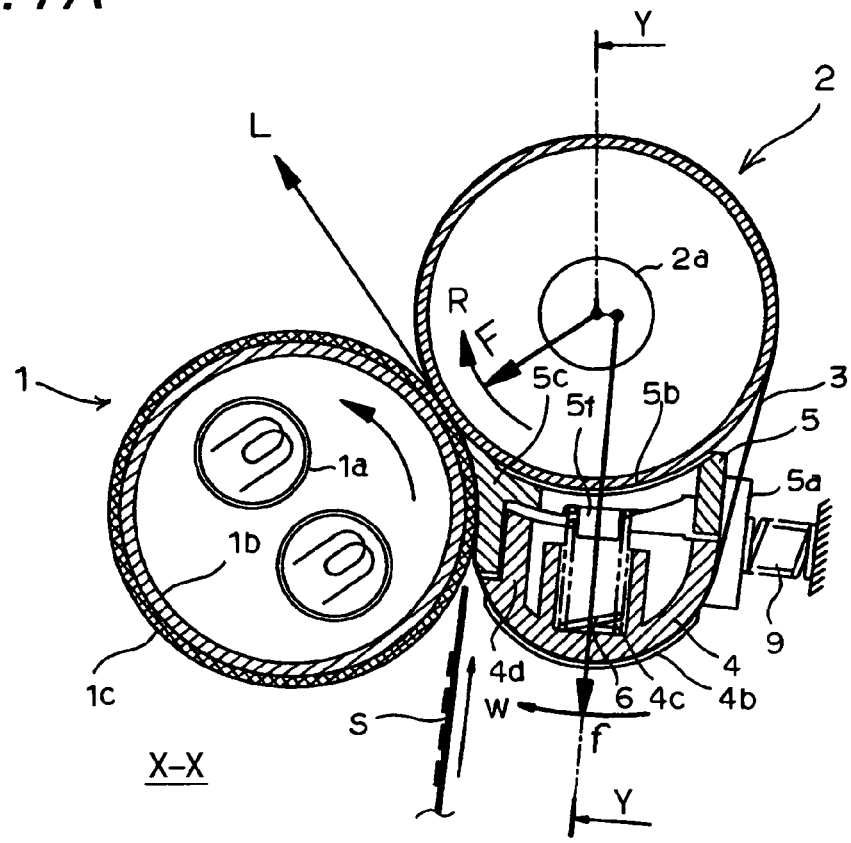
FIG. 7 illustrates views for explaining a second embodiment of a fusing unit of the invention.
Figure 7B:
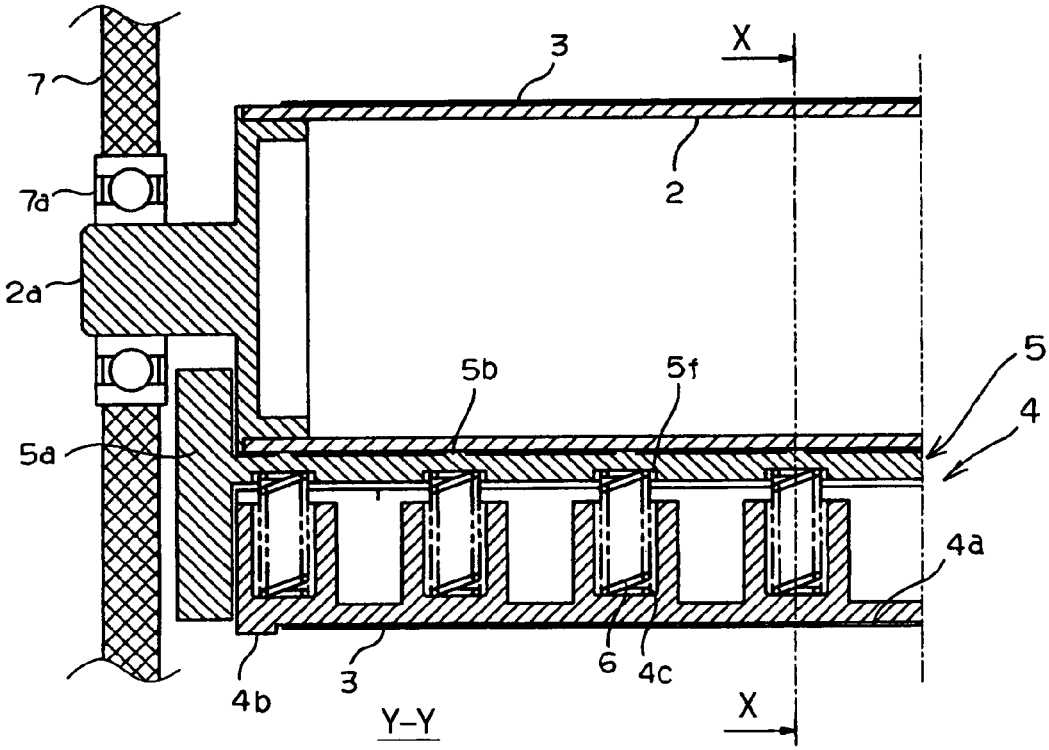
Figure 8:
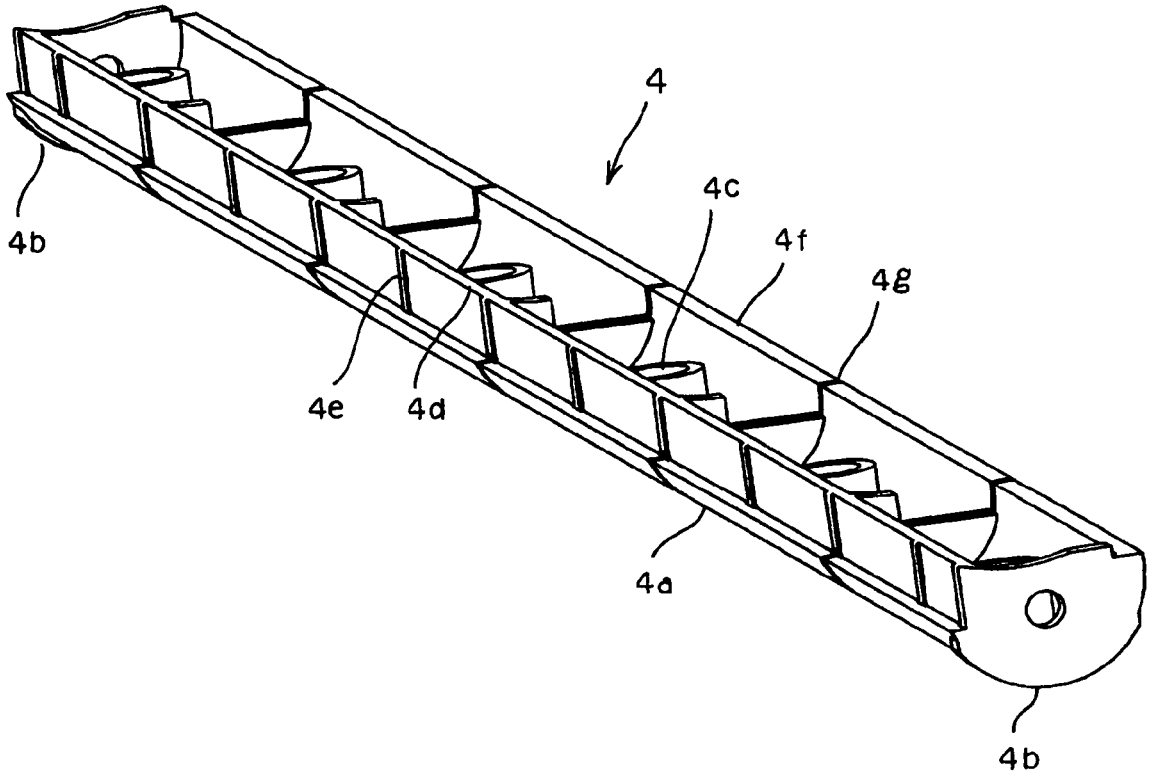
FIG. 8 is a perspective view viewed from the side of a pressing roller of a belt stretching member of the fusing unit shown in FIG. 7.
Figure 9:
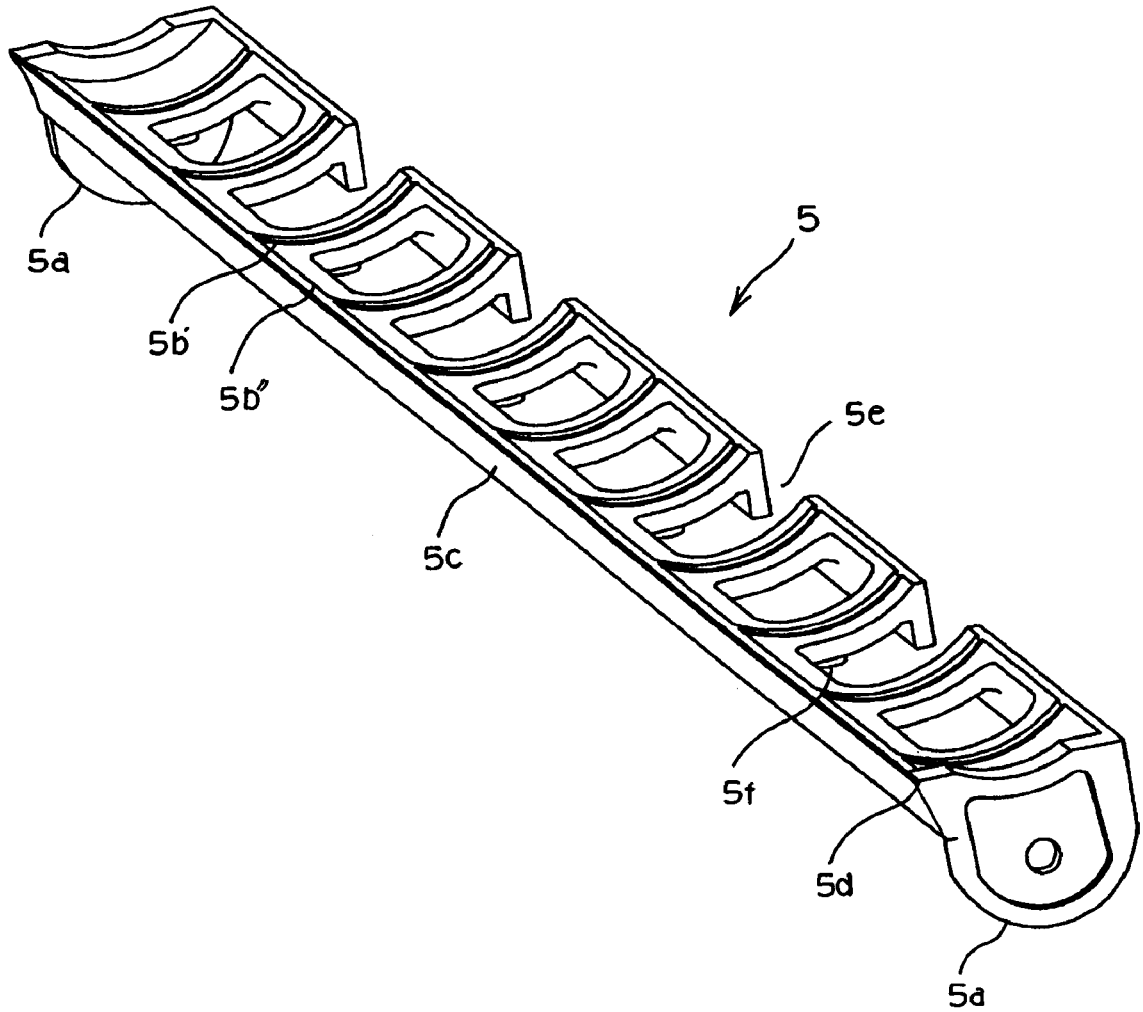
FIG. 9 is a perspective view viewed from the side of a pressing roller of a nip pressing member of the fusing unit shown in FIG. 7.
Figure 10:
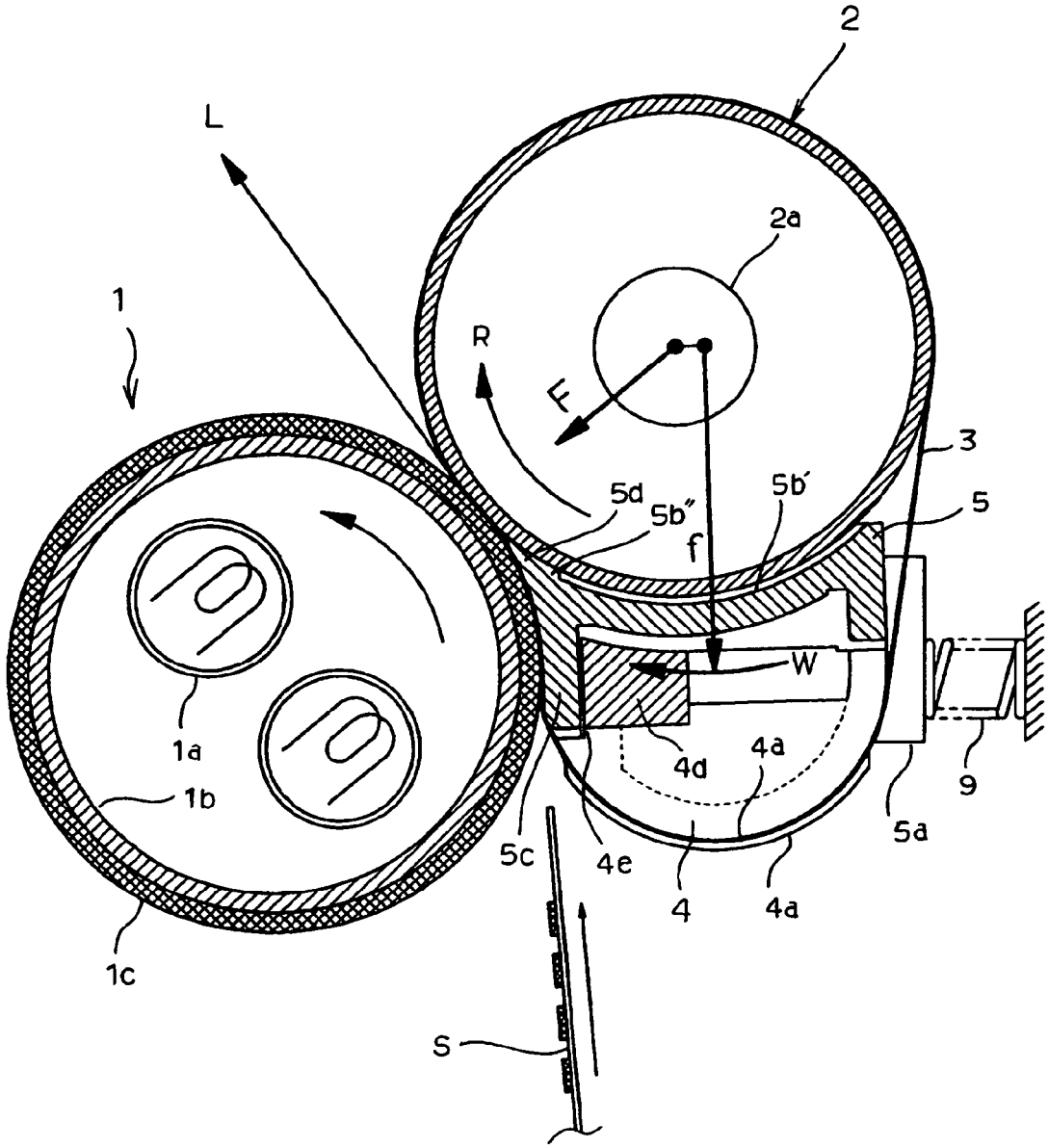
FIG. 10 is a view enlarging to show a fusing nip portion of the fusing unit shown in FIG. 7.

Next, a second embodiment of the invention will be explained in reference to the drawings as follows. FIG. 7 shows an embodiment of a fusing unit according to the invention, FIG. 7(A) is a sectional view taken along a line X-X of FIG. 7(B) and viewed in an arrow direction, and FIG. 7(B) is a sectional view taken along a line Y-Y of FIG. 7(A), in which a right half of the apparatus is omitted. FIG. 8 is a perspective view of a belt-stretching member of the fusing unit shown in FIG. 7 viewed from the side of a pressing roller thereof, FIG. 9 is a perspective view of a nip pressing member of the fusing unit shown in FIG. 7 viewed from the side of the pressing roller, and FIG. 10 is a view enlarging to show a fusing nip portion of the fusing unit shown in FIG. 7. The components identical with those shown in the first embodiment are denoted by the same reference numerals.

In FIG. 7, A heating roller 1 is formed by coating the outer peripheral face of a pipe material with an elastic body 1*c* having a thickness of 0.4 mm or thereabouts. The pipe material has an outer diameter of about 25 mm and a thickness of about 0.7 mm and is taken as the roller base material 1*b*. The heating roller 1 incorporates as the heat sources two columnar halogen lamps 1*a*, each consuming electric power of 1050 watts. A pressing roller 2 is formed by coating an outer peripheral face of a pipe material with an elastic material having a thickness of about 0.2 mm. The material has, e.g., an outer diameter of about 25 mm and a thickness of about 0.7, mm and is taken as a roller base material. The pressing roller 2 is configured such that compression force arising between the heating roller 1 and the pressing roller 2 assumes a value of 10 kg or less and such that a nipping length assumes a value of about 10 mm. The pressing roller 2 is disposed opposite the heating roller 1 and is rotatable in the direction of the illustrated arrow R. Rotating shafts 2*a* at both ends of the pressing roller 2 are rotatably supported by the left and right frames 7 via bearings 7*a* as shown in FIG. 7(B).

The heat-resistant belt 3 is an endless belt which is nipped between the heating roller 1 and the pressing roller 2 and made movable while being stretched around the outer peripheral face of the pressing roller 2 and that of a belt stretching member 4. The heat-resistant belt is formed from, e.g., a metal tube having a thickness of about 0.03 mm or more, such as a stainless steel tube or an electro-galvanized nickel tube, or a heat-resistant resin tube such as polyimide or silicon.

The belt stretching member 4 is a sliding member (the heat-resistant belt 3 is a member sliding on the belt stretching member 4) which is substantially in the shape of a half moon and insertingly fitted to an inner periphery of the heat-resistant belt 3 for applying a tension "f" to the heat-resistant belt between the belt stretching member 4 and the pressing roller 2. The belt stretching member 4 is disposed at a position where a nip is formed by wrapping the heat-resistant belt 3 around the heating roller 1 on the upstream side of the nipping portion of the heating roller 1 and the pressing roller 2, with respect to the transporting direction of the sheet medium S. Further, the belt stretching member 4 is disposed at a position where the sheet medium is guided to a nip portion to be brought in noncontact with the heating roller through the heat-resistant belt 3 in advancing the sheet medium. Further the belt stretching member 4 is disposed to be pivotably in a direction of an arrow W centering on the rotating shaft 2*a* of the pressing roller 2 and stretches the heat-resistant belt 3 in a tangential direction of the heating roller 1 in a state where the sheet medium S does not pass the fusing nip. The second embodiment differs from the first embodiment on the point that the belt stretching member 4 is disposed to be brought into noncontact with the heating roller when the sheet medium passes the nip portion. Although there is a case in which when the fusing pressure is large at the initial position of advancing the sheet medium S to the fusing nip, a sheet medium S is not advanced smoothly and is fused in a state of folding a front end of the sheet medium S, when the heat-resistant belt 3 is stretched in a tangential direction of the heating roller 1, an introducing port portion for advancing the sheet medium S smoothly can be formed and the sheet medium S can be advanced smoothly.

The nip pressing member 5 is a sliding member sliding on the pressing roller 2 and includes the sliding contact portion 5*b* which is brought into sliding contact with the pressing roller 2 along an outer periphery thereof and the pressing portion 5*c* for pressing the heat-resistant belt 3 to the heating roller 1 on an upstream side of the nip portion. The nip pressing member 5 is urged by a spring slightly in a direction of the pressing roller 2. Thus a friction force is imparted along the outer periphery of the pressing roller 2 with rotation of the heating roller 2, the nip pressing member 5 slides, and the pressing portion 5*c* presses the heating roller 1 through the heat-resistant belt 3. As a result, a front end of the pressing portion 5*c* is made to bite the nip portion.

As shown in FIG. 8, the belt stretching member 4 includes the projected wall(s) 4*b* for restricting meandering of the heat-resistant belt at both ends or one end of the belt sliding face 4*a* and includes the spring receive portion 4*c* at a position on a back side of the belt sliding face 4*a* opposed to the spring arranging portion 5*f* of the nip pressing member 5, mentioned later. Further, the wall portion 4*d* integral in an axial direction is provided on the side of the heating roller 1, that is, on a downstream side of the belt sliding face 4*a* and a plurality of pressing portions 4*e* in a projected shape brought into contact with the nip pressing member 5 are provided at an equal interval on the wall portion 4*d*, and the belt stretching member 4 is provided with a wall portion 4*f* on an upstream side of the belt sliding face 4*a* and an opening portion (slit portion, notched portion) 4*g* discontinuously opened at the belt sliding face 4*a*.

As shown in FIG. 9, the nip pressing member 5 constitutes a guide portion in which the flanges 5*a* are formed at the both ends thereof to extend to both end faces of the pressing roller 2 and the belt stretching member 4. The flanges 5*a* guides the pressing roller 2 and the belt stretching member 4 while being in contact with the both ends faces. A contact portion of the guide portion which is brought into contact with the end faces of the pressing roller 2 and the belt stretching member 4 may not be a face brought into sliding contact therewith, but may be a plurality of projections, or a ball or a roller brought into pivoting contact therewith, or the portion may be not provided at the nip pressing member 5 but may be provided at a counter side thereof. Further, the nip pressing member 5 constitutes a plurality of circular arc shape projected portions 5*b*' disposed substantially at an equal interval in an axial direction and brought into sliding contact with the pressing roller 2 along an outer periphery thereof and a sliding contact face 5*b*" an entire face of which is brought into sliding contact with the pressing roller 2 continuously in an axial direction at a front end on the side of the nip portion as the sliding contact portion 5*b* at an inner face thereof, and includes a curved face in correspondence with a radius of curvature of the heating roller 1 including a thickness of the heat-resistant belt 3 for pressing the heat-resistant belt 3 to the heating roller 1 by a constant width in an axial direction as the pressing portion 5*c* at a side face thereof. Further, the pressing portion 4*e* having a projected shape of the belt stretching member 4 is brought into contact with a face on a back side of the pressing portion 5*c*.

Figure 11:
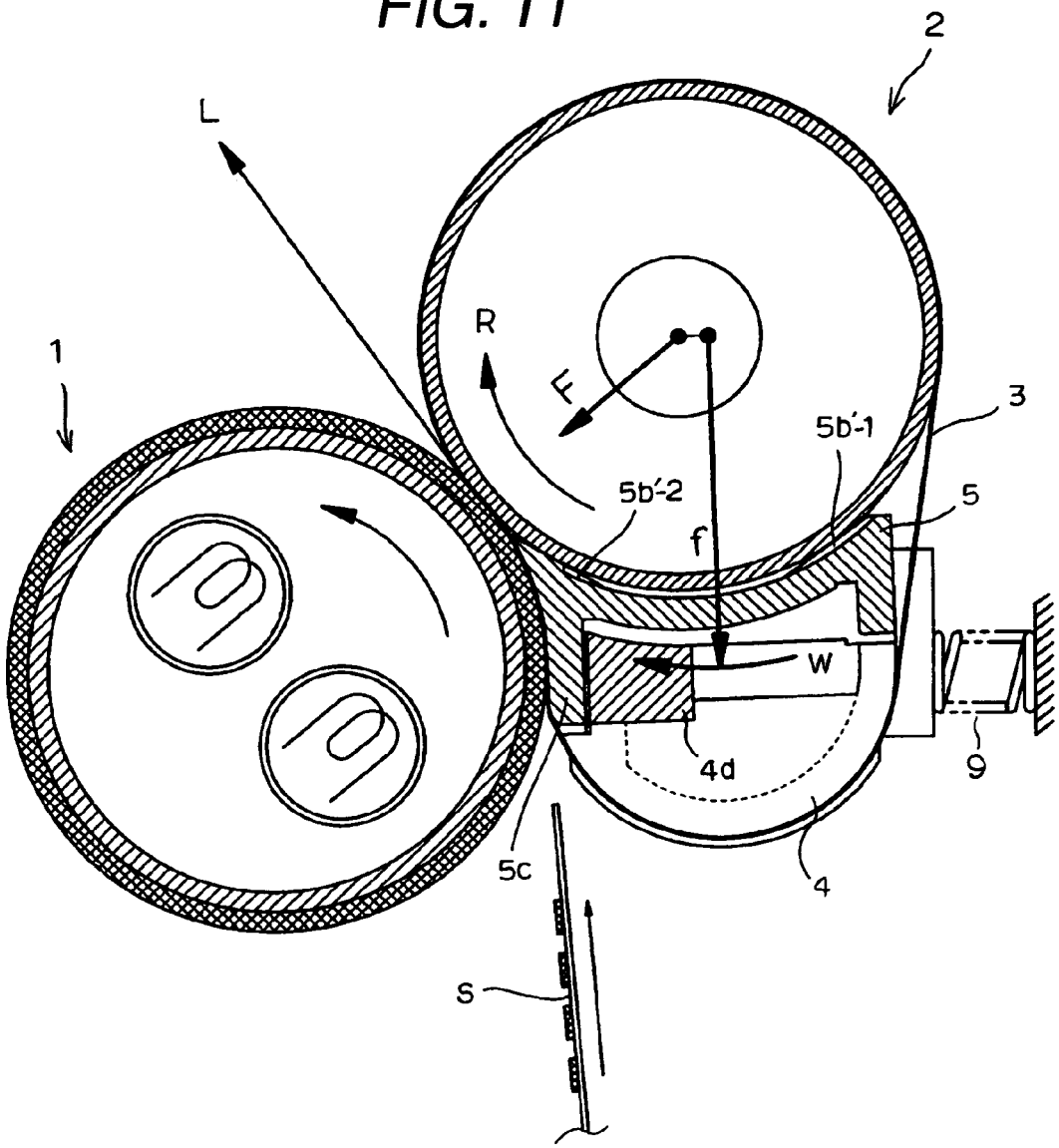
FIG. 11 is a view showing a modified example of the fusing unit shown in FIG. 7.

In this way, as shown in FIG. 7 and FIG. 11, the front end 5*d* of the nip pressing member 5 is formed to be an acute angle in a wedge-like shape by a predetermined radius of curvature by projecting and extending the front end 5*d*, the sliding contact face 5*b*" is brought into sliding contact with the outer periphery of the pressing roller 2 over an entire face in an axial direction by a constant width, and the pressing portion 5*c* is pressed to the heating roller 1 over an entire face in an axial direction via the heat-resistant belt 3 to bite the nip portion of the heating roller 1 and the pressing roller 2. Thereby, even when a rigidity is reduced, deformation of the shape is restricted by the heating roller 1 and the pressing roller 2 and therefore, even when a member made of a plastic material or the like having a low rigidity in which the heat capacity is small to be effective in shortening a warming up time period is used, a desired stable shape can be maintained by preventing contact of the nip portion from being unstable by a deficiency in the rigidity or thermal deformation of the front end 5*d*, a sufficient pressing force of the nip can be ensured even at the front end 5*d* and thin-size and light-weighted formation can be achieved. Further, by providing the notched portion 5*e* at a portion other than the nip portion of the nip pressing member 5, that is, a portion on a side opposed to the side of the heating roller 1 to form a discontinuous and opened portion, even when the nip pressing member 5 is heated from the side of the heating roller 1 to produce a temperature difference from the opposed side, the nip pressing member 5 can be prevented from being deformed by producing warp by a difference in thermal expansion.

Further, according to the embodiment, the nip pressing member 5 is formed with the spring arranging portion (hole) 5*f* on a back side of the sliding contact portion 5*b* and the spring arranging portion 5*f* is disposed with the spring 6 between the spring arranging portion 5*f* and the belt stretching member 4. Further, as shown in FIG. 7(B), the end face of the pressing roller 2 and the flange 5*a* are brought into contact with each other by constituting the guide portion by the flange 5*a*, the pressing roller 2 and the belt stretching member 4 are disposed to be disposed between the flanges 5*a* of the nip pressing member 5, and the nip pressing member 5 and the belt stretching member 4 are positioned relative to the pressing roller 2. By the constitution, the tension in accordance with urge forces of the respective springs 6 is imparted to the belt stretching member 4, and the tension f is applied to the heat-resistant belt 3. At the same time, a force of pivoting the pressing roller 2 is transmitted to the nip pressing member 5 by the friction force between the pressing roller 2 and the sliding contact portion 5*b*, and the heat-resistant belt 3 can be pressed to the heating roller 1 by way of the pressing portion 5*c*.

Further, in accordance with driving the heat-resistant belt 3, by the friction force between the heat-resistant belt 3 and the belt sliding face 4*a*, the belt stretching member 4 is urged to pivot to the side of the heating roller 1, the projected shape pressing portion 4*e* presses the back side of the pressing portion 5*c* of the nip pressing member 5 and therefore, the pressing force of the pressing portion 5*c* is applied thereto. Further, as shown in FIG. 7(B) and FIG. 4, when the urge force by the spring 9 is imparted to the flange 5*a* in the direction of the arrow W, the pressing force of the pressing portion 5*c* can further be increased.

Figure 12:
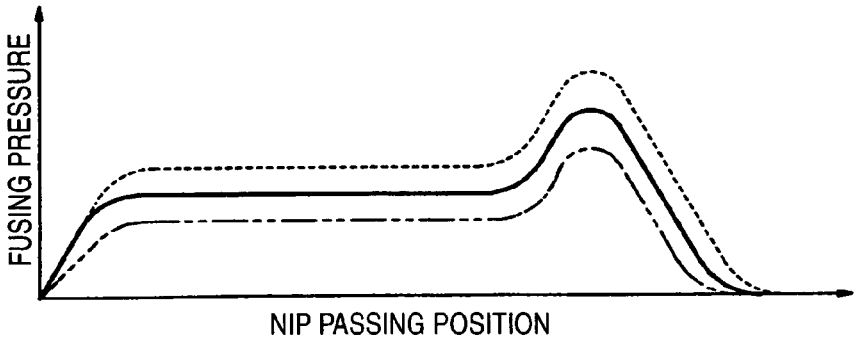
FIG. 12 is a diagram showing a nip passing position and variations in a fusing pressure.

FIG. 11 shows a sectional shape showing a modified example of the fusing unit of FIG. 7. FIG. 12 is a diagram showing a nip passing position and variations in the fusing pressure. In FIG. 7, the inner face of the nip pressing member 5 is formed to have the sliding contact portion 5*b* in the projected shape whose curvature radius is substantially the same as that of the outer peripheral face of the pressing roller 2 and is disposed to be brought into sliding contact with the pressing roller 2. However, according to an embodiment shown in FIG. 5, the sliding contact portion 5*b* brings the nip pressing member 5 into sliding contact therewith by a synthesized force of vectors at two positions 5*b*'-1, 5*b*'-2 along the outer peripheral face of the pressing roller 2.

As shown in FIG. 12, in general a difference arises in the fusing pressure according to the thickness of the sheet medium. However, at the nip region, the fusing pressure becomes a constant fusing pressure by pressing by the nip pressing member 5 from a nip initial position, and the fusing pressure is increased by pressing by the pressing roll at a nip finish position. Additionally, dashed lines denote variations in fusing pressure achieved in the case of a thick sheet medium; solid lines denote variations in fusing pressure achieved in the case of a sheet medium having a standard thickness; and dashed chain lines denote variations in fusing pressure achieved in the case of a thin sheet medium.

Figure 13A:
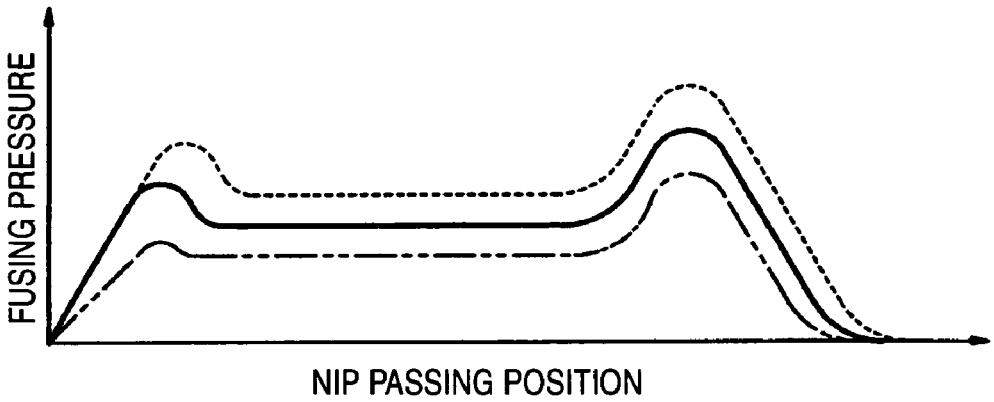
FIG. 13 illustrates diagrams showing a nip passing position and variations in a fusing pressure increasing a force of urging a belt stretching member by a spring.
Figure 13B:
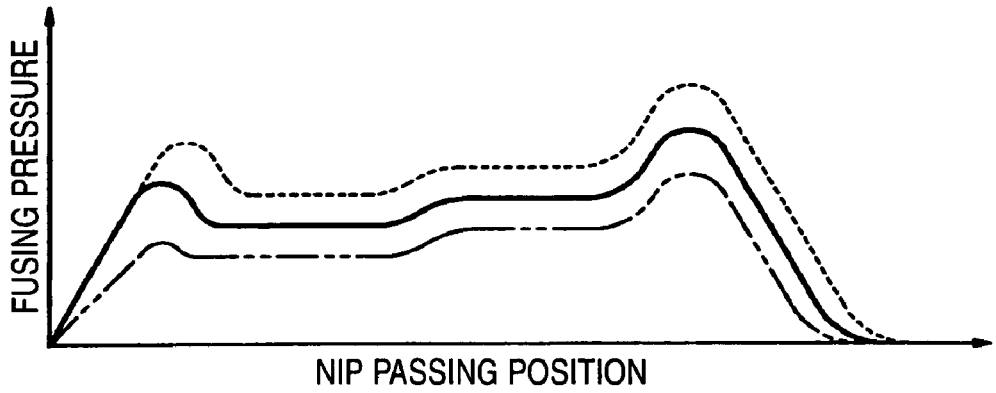
Figure 14A:
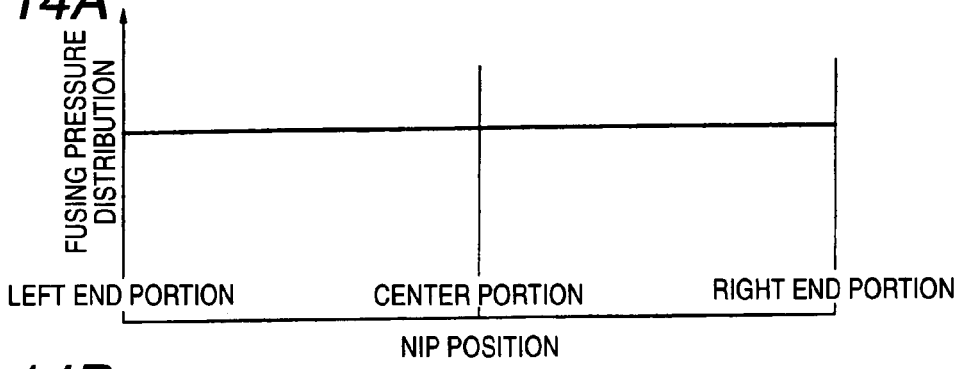
FIG. 14 illustrates diagrams showing examples of setting fusing pressure distributions by a spring.
Figure 14B:
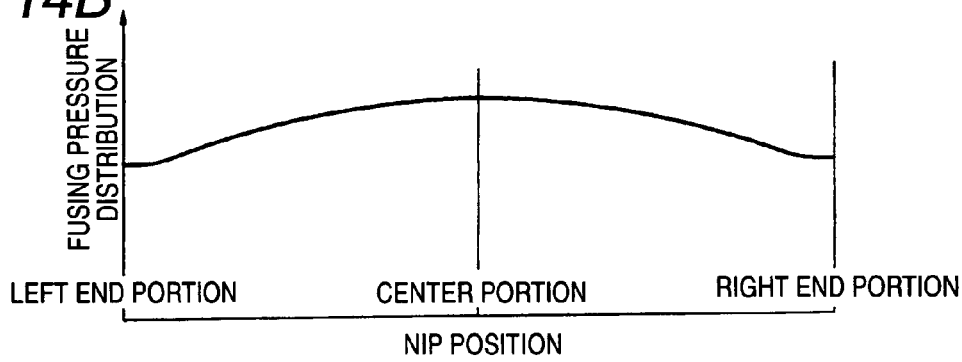
Figure 14C:
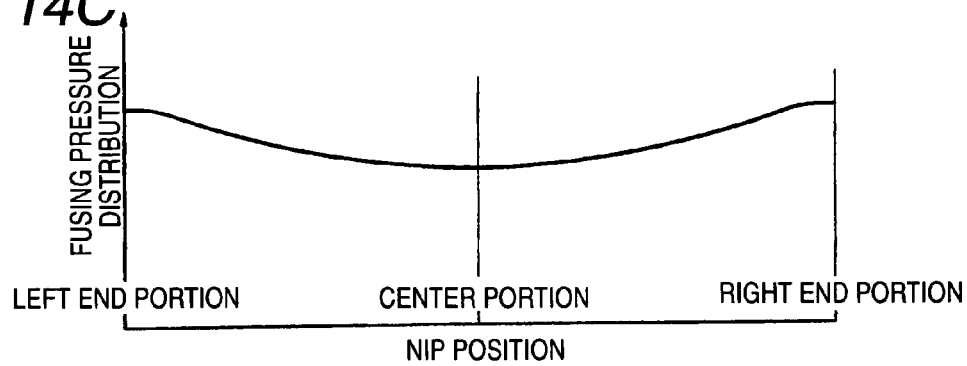
Figure 14D:
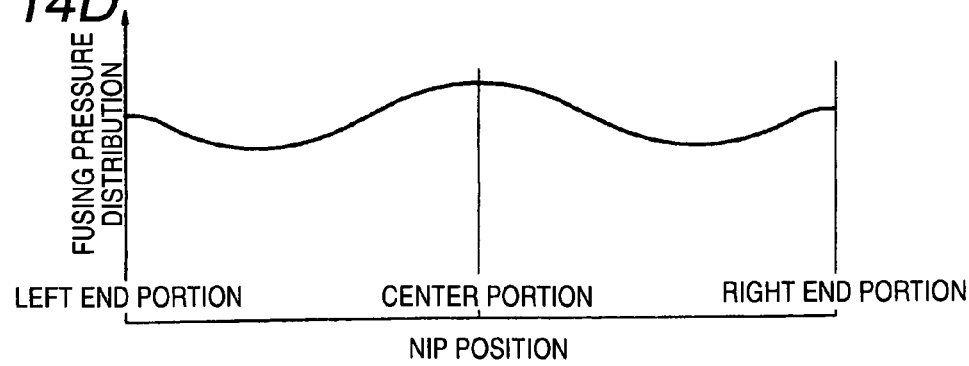

Although in the previous embodiments, the spring 9 is disposed at the portion where the nip pressing member 5 lightly presses the heating roller 1, there may be constituted a light press urging means which is disposed between an end portion of the projected wall 4*b* of the belt stretching member 4 and the frame on a side opposed to the heating roller 1 and urges the belt stretching member 4 in a direction where the belt stretching member 4 lightly presses the heating roller 1 from the inner side of the heat-resistant belt 3. When the belt stretching member 4 presses the back side of the pressing portion 5*c* of the nip pressing member 5 by being urged by the spring 9, and the pressing portion 5*c* of the nip pressing member 5 is lightly pressed to the heating roller 1 from the inner side of the heat-resistant belt 3 and the heat-resistant belt 3 is brought into sliding contact with the heating roller 1. As a result, as shown in FIG. 13, the fusing pressure can be increased even at the nip initial position. Naturally, even when the spring 9 is omitted, by adjusting the friction force between the pressing roller 2 and the nip pressing member 5 and the friction force between the heat-resistant belt 3 and the stretching member 4, the pressing portion 5*c* can be positioned with a desired pressing force.

According to the embodiment, two pieces of the heat sources 1*a* are included at inside of the heating roller 1, when heat generating elements of the halogen lamp are constituted at different arrangement to be lighted selectively, a temperature control can easily be carried out under a different condition such as the fusing nip portion at which the heat-resistant belt 3, mentioned later, is wound around the heating roller 1 and a portion at which the belt stretching member 4 is brought into sliding contact with the heating roller 1, or a different condition such as a sheet medium having a wide width and a sheet medium having a narrow width.

Further, according to the embodiment, the outer diameters of the heating roller 1 and the pressing roller 2 are constituted to be a small diameter of about 25 mm and therefore, the fused sheet medium S is not made to wrap around the heating roller 1 or the heat-resistant belt 3 and therefore, means for peeling off the sheet medium S forcibly therefrom is not needed. Further, when a PFA layer of about 30 μm is provided at a surface layer of the elastic member 1*c* of the heating roller 1, the rigidity is increased by an amount in accordance with the PFA layer, the surface layer is elastically deformed substantially uniformly, a so-to-speak horizontal nip is formed, a speed of carrying the heat-resistant belt 3 or the sheet medium S does not differ from the peripheral speed of the heating roller 1, and the image can be fused extremely stably.

When the belt stretching member 4 is constituted by a nonrotating member for sliding the heat-resistant belt 3 as in the embodiment, since the belt stretching member 4 is not a rotating member, a bearing or the like is not needed and therefore, a structure of supporting the belt stretching member 4 becomes simple. In addition thereto, by constituting the belt stretching member 4 substantially by a shape of the half moon, the belt stretching member 4 can be disposed on the side of the pressing roller 2 by being directed in a direction of a chipped portion of the half moon and the belt stretching member 4 can be disposed to be extremely proximate to the pressing roller 2. Thereby, the peripheral length of the heat-resistant belt 3 can be constituted to be shortened. Therefore, the sheet roll type fusing unit can be small-sized and inexpensive with a simple structure.

The heat-resistant belt 3 is moved by a necessary minimum path and therefore, thermal energy deprived when the heat-resistant belt 3 is heated at the nip portion between the heat-resistant belt 3 and the heating roller 1 including the heat source rotatably and moved on a predetermined path can be minimized. Further, since the peripheral length can be shortened, a temperature drop by natural heat radiation is also small, and the so-to-speak warming up time period from when the power source is made ON until when temperature reaches a desired one at which the sheet can be fused can be shortened. Further, as shown in FIG. 1, the heat-resistant belt 3 is applied with tension in corporation with the pressing roller 2 and the belt stretching member 4 and wrapped around the heating roller 1 to form the nip and therefore, the nip length can easily be constituted to be long, the structure becomes simple and can be made to be small-sized and inexpensive.

Although in order to drive the heat-resistant belt 3 stably by the pressing roller 2 with being stretched to the pressing roller 2 and the belt stretching member 4, a friction coefficient between the pressing roller 2 and the heat-resistant belt 3 may be set to be larger than a friction coefficient between the belt stretching member 4 and the heat-resistant belt 3, with regard to the friction coefficients, there is a case in which the friction coefficients become unstable due to invasion of a foreign matter or wear. In contrast thereto, when an angle of wrapping the heat-resistant belt 3 around the belt stretching member 4 is set to be smaller than an angle of wrapping the heat-resistant belt 3 around the pressing roller 2, further, a diameter of the belt stretching member 4 is set to be smaller than a diameter of the pressing roller 2, a length of sliding the heat-resistant belt 3 on the belt stretching member 4 becomes short, and the heat-resistant belt 3 can stably be driven by the pressing roller while preventing an unstable factor of an aging change, a disturbance or the like.

Further, in order to stably fuse the nonfused toner image formed on the sheet medium S, it is indispensable to sufficiently melt the nonfused toner image and fuse the nonfused toner image, and a desired temperature and a melting time period are needed. However, according to the constitution of the embodiment, as shown in FIG. 1, the heat-resistant belt 3 is stretched on the belt stretching member 4 while applied with the tension, and wrapped around the heating roller 1 to form the nip. Additionally, the pressing roller 2 presses the heat-resistant belt 3 from the inside of the heat-resistant belt 3 and the nip pressing member 5 and the belt stretching member 4 lightly presses the heat-resistant belt 3. Accordingly, there is not need for providing means for prolonging the nip length by considerably warping the elastic member covered on the surface of the heating roller 1 in order to prolong the nip length, and the thickness of the elastic member can be constituted to be thin. Further, it is not necessary to set the press contact pressure of the pressing roller 2 to be large in order to warp the elastic member, a stress imparted to the passing sheet medium when the sheet medium S carrying the nonfused toner image passes between the heating roller 1 and the heat-resistant belt 3 is small and therefore, the sheet medium S discharged after fusing the nonfused toner image can be restrained from deformation such as wrinkle.

Therefore, not only it is not necessary to increase the mechanical rigidity of the heating roller type fusing unit but also the heating roller 1 can be formed with thin wall structure and a heating speed of heating the heat-resistant belt 3 by the heating source is increased. Further, also the pressing roller 2 can similarly be formed with thin wall structure, a heat capacity can be constituted to be small and therefore, absorption of thermal energy from the heat-resistant belt is small and the so-to-speak warming up time period from when the power source is made ON until when temperature reaches a desired one at which the sheet can be fused can be shortened.

By constituting the belt stretching member 4 in a crown shape whose vicinity of a center in an axial direction is projected slightly in a projected shape, a tension imparted to the heat-resistant belt 3 at the vicinity of a center is increased. Therefore shifting of the heat-resistant belt 3 to the end portion or meandering thereof is eliminated, the heat-resistant belt 3 can smoothly be slid on the sliding face of the belt stretching member 4, and a state of deforming the belt stretching member 4 to be substantially straight can also be provided. The crown shape is effective in forming the stable fusing nip by forming the crown shape not only in the direction of stretching the heat-resistant belt 3 but also in a direction of lightly pressing the heat-resistant belt 3 to the heating roller 1.

Further, when a line passing an axis core of the spring 6 is disposed on a line passing a position shifted from an axis core of the rotating shaft 2*a* of the pressing roller to an outer side relative to the heating roller 1 as shown in FIG. 1, a direction of urging the belt stretching member 4 becomes a direction of pressing the heat-resistant belt 3 to the heating roller 1 by a component of the urging force. Further, in this case, a reaction force imparted to the nip pressing member 5 by the spring 6 is in a direction reverse to a sliding direction in accordance with rotation of the pressing roller 2 and therefore, a friction force imparted to the sliding contact portion 5*b* of the nip pressing member 5 in accordance with rotation of the pressing roller 2 is set to be larger than at least the reaction force. Thereby, the component of the urge force exerted to the belt stretching member 4 is added to the pressing force of lightly pressing the heat-resistant belt 3 to the heating roller 1. The fusing nip in which the heat-resistant belt 3 is wrapped around the heating roller 1 and the pressed state is made continuous can be formed from the portion at which the nip pressing member 5 is lightly pressed to the heating roller 1 to a portion at which the pressing roller 2 is pressed to the heating roller 1 and therefore, the fusing nip can be formed further stably.

The heat-resistant belt 3 which is wrapped around the outer peripheral face of the pressing roller 2 and travels while being nipped between the pressing roller 2 and the heating roller 1 is stretched by the belt stretching member 4 to turn itself around the heating roller 1, thereby forming a nipping portion. In this case, there may arise a case where axial deflection occurs in the belt stretching member 4 or where creeping deformation arises under influence of the heating roller 1 which is heated to a temperature as high as about 200° C. Particularly, when the stretcher 4 is formed from a plastic material having low thermal capacity, on the assumption that the belt stretching member 4 is effective for shortening a warm-up time, the phenomenon of occurrence of deflection or deformation has become noticeable, which is not preferable for forming a stable nipping portion. According to the embodiment, the tension in accordance with the urge forces of the respective springs 6 is imparted to the belt stretching member 4 over an entire region in the axial direction and therefore. As the result, the axial deflection or the creep deformation can be prevented by a predetermined allowable width and therefore, the uniform and stable fusing nip can be formed over an entire region in the axial direction.

FIG. 14 illustrates diagrams showing examples of setting a distribution of the fusing pressure by the spring. When there is adopted the constitution of exerting the tension to the heat-resistant belt 3 by arranging a plurality of the springs 6 between the belt stretching member 4 and the nip pressing member 5 in the embodiment, by adjusting the urge forces of the plurality of springs 6 and selectively combining the urge forces, an arbitrary and desired fusing pressure distribution can be set in the direction of the belt stretching member 4 in accordance with the object.

In FIG. 14(*a*), the urge forces of the plurality of springs 6 are selectively disposed to constitute an equally distributed fusing pressure. When the nonfused toner image formed on the sheet medium is fused by passing the fusing nip portion, a fusing property such as a fusing strength and a fusing luster is controlled by a temperature and a pressure of the fusing nip portion. Therefore, by constituting the equally distributed fusing pressure, a fused image having a uniform fusing property over an entire region of the sheet medium can be provided.

In FIG. 14(*b*), the urge forces of the plurality of springs 6 are selectively disposed to constitute a fusing pressure distribution in which a center portion is large and both end portions are small. Although when the heating roller 1, the pressing roller 2, the belt stretching member 4, and the nip pressing member 5 are axially deflected, the fusing pressure at the center portion is reduced to bring about an unprferable state, by setting the urge forces of the plurality of springs 6 such that a center portion of the belt stretching member 4 is large and both end portions are small, a fused image having a uniform fusing property over an entire region of the sheet medium can be provided.

In FIG. 14(*c*), urge forces of the plurality of springs 6 are selectively disposed to constitute a fusing pressure distribution in which the both end portions are large and the center portion is small. When the nonfused toner image formed on the sheet medium is fused by passing the fusing nip portion, there is a case in which due to a balance between the fusing pressure and a force of carrying the sheet medium, there is brought about wrinkle or the like at the center portion of the sheet medium, which is not preferable. As a countermeasure, a pair of rollers having an inverse crown shape in which a center portion of an outer diameter of the pressing roller or the heating roller is small is used and thereby increasing a force of carrying the both end portions of the sheet medium. According to the embodiment, by setting the urge force of the plurality of springs 6 such that the both end portions of the belt stretching member 4 is large and the center portion is small, the force of carrying the sheet medium at the both end portions can be increased, and there can be achieved an effect equivalent to that of the above-described content for preventing wrinkle brought about at the center portion of the sheet medium by increasing the force of carrying the both end portions of the sheet medium by using the pair of rolls having the inverse crown shape for making the center portion of the outer diameter of the pressing roller or the heat fusing roll slender.

FIG. 14(*d*) shows a case in which the urging forces of the plurality of springs 6 are set to be large at the both end portions and the center portion of the belt stretching member 4. In this case, a fusing pressure distribution thereof is formed by combining those of FIGS. 14(*b*) and (*c*) and the fusing pressure at the center portion can be increased and the force of carrying the sheet medium at the both end portions can be increased.

Figure 15:
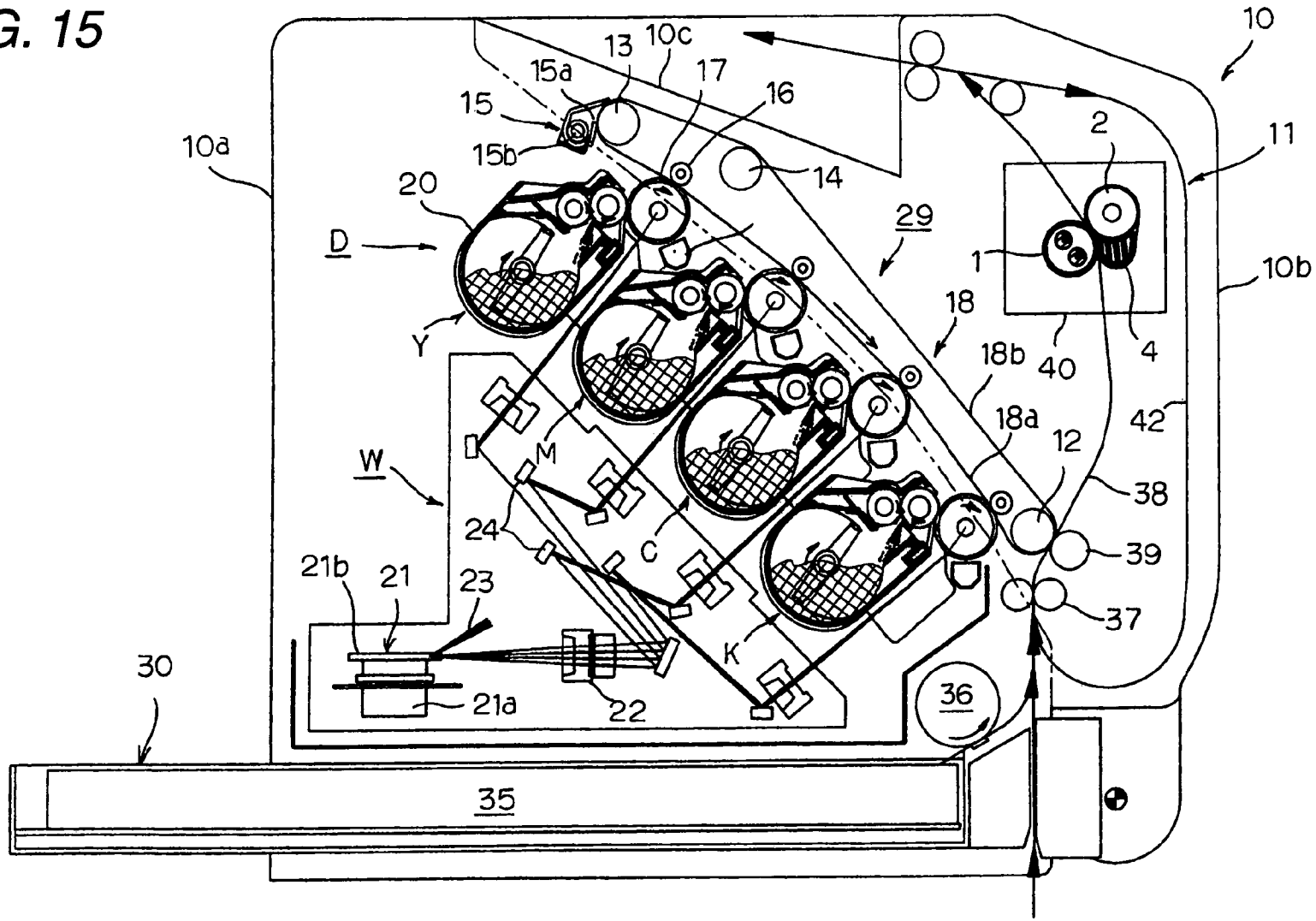
FIG. 15 is a schematic sectional view showing an example of an image forming apparatus according to the invention.

FIG. 15 schematically shows an image forming apparatus 10 configured to incorporate the fusing device of the invention. The image forming apparatus 10 comprises: a housing 10*a*; a door body 10*b*; a sheet transporting unit 11; a cleaner 15; an image carrier 17; an image transferer 18; developing devices 20; an optical scanner 21; a rotary polygon mirror 21*b*; a transfer belt unit 29; a sheet feeding unit 30; a fuser 40; an exposer W; and an image forming unit D.

A sheet ejecting tray 10*c* is formed in an upper portion of the housing 10*a* and the door body 10*b* reclosably attached to the front face of the housing 10*a*. The exposer W, the image forming unit D, the transfer belt unit 29, and the sheet feeding unit 30 are provided within the housing 10*a*. The sheet transporting unit 11 is provided within the door body 10*b*. Respective units are configured so as to be removably attached to the main body and temporarily removed for repair or replacement at the time of maintenance or the like.

The image forming unit D comprises Y (yellow), M (magenta), C (cyan), and K (black) image forming stations which form images of a plurality of different colors (four colors in the present embodiment). Each of the Y, M, C, K image forming stations comprises the image carrier 17 formed from a photosensitive drum, a charger 19, and a developing device 20, both of which are disposed around the image carrier 17. The respective image forming stations Y, M, C, and K are disposed in parallel below the transfer belt unit 29 along an oblique arch-shaped line such that the image carriers 17 are oriented upward. The image forming stations Y, M, C, and K are disposed in an arbitrary sequence.

The transfer belt unit 29 has a drive roller 12 which is disposed at a position below the housing 10*a* and rotationally driven by an unillustrated drive source; a driven roller 13 disposed at an upper oblique position with reference to the drive roller 12; a backup roller (tension roller) 14; the image transferer 18 formed from an intermediate transfer belt which is circulated in the direction of the illustrated arrow (in the countercheck direction X) while being stretched between at least two of these three rollers; and the cleaner 15 that comes into contact with the face of the image transferer 18. The driven roller 13, the backup roller 14, and the image transferer 18 are disposed in the direction inclined leftward in the drawing with reference to the drive roller 12. As a result, a belt face 18*a* whose transporting direction X is oriented downward during driving of the image transferer 18 is located at a lower position, whereas a belt face 18*b* whose transporting direction is oriented upward is situated at a higher location.

Consequently, the image forming stations Y, M, C, and K are disposed in a direction leftwardly inclined with reference to the drive roller 12 in the drawing. The image carriers 17 come into contact with the belt face 18*a* that faces downward with respect to the transporting direction of the image transferer 18 along the arch-shaped line. As indicated by the illustrated arrow, the image carriers 17 are rotated in the transporting direction of the image transferer 18. The image transferer 18 assuming the shape of an elastic endless sleeve is brought into contact with the image carriers 17 at an essentially-identical wrap angle in such a way that the image carriers 17 are covered with the image transferer 18 from above. Accordingly, the contact pressure and the width of nipping portion defined between the image carriers 17 and the image transferer 18 can be adjusted by controlling the tensile force imparted to the image transferer 18 by the tension roller 14, the interval between the image carriers 17, and the wrap angle (the curvature of the arch).

The drive roller 12 serves as a backup roller of a secondary transfer roller 39. For instance, a rubber layer having a thickness of 3 mm or thereabouts and a volume resistivity of $10^5$ Ωcm or less is formed on the periphery of the drive roller 12. The drive roller 12 is grounded by way of a metal shaft, thereby acting as a conductive channel of a secondary transfer bias supplied by way of the secondary transfer roller 39. The diameter of the drive roller 12 is made smaller than that of the driven roller 13 and that of the backup roller 14. As a result, removal of the recording paper which has been subjected to secondary transfer of an image can be facilitated by the elastic force of the recording paper itself. Further, the driven roller 13 doubles as a backup roller for the cleaner 15 to be described later.

A primary transfer member 16 is disposed, at a position where it comes into contact with the inside of the image transferee, as a transfer bias applier which forms an image by sequentially transferring toner images one on top of the other in an overlapping manner. However, the only requirement is to bring the primary transfer member 16 into contact with the inside of the image transferer to ensure application of power to the image transferee. Hence, the primary transfer member 16 can be formed as, e.g., a conductive roller or a rigid contact which is rotationally drive upon contact with the image transferer or a conductive elastic member such as a leaf spring or a conductive brush or the like made of a bundle of resin fibers or the like.

As mentioned previously, the image forming apparatus is configured such that the plurality of image carriers 17 are disposed in parallel; such that the image transferer 18 possessing flexibility is disposed in a contacting manner in a position having an essentially identical wrap angle with respect to the respective image carriers 17; such that the image transferer 18 is stretched by at least two rollers 12, 13 and circulated; and such that tensile force is imparted to the image transferer 18 by any of the rollers 12, 13, thereby sequentially transferring the toner images of the image carriers 17 in a superimposed manner. Essentially-identical nipping portions are readily formed in the contact section between the image carriers 17 and the image transferer 18 in accordance with the essentially-identical wrap angles, thereby rendering the contact pressures substantially identical with each other.

The cleaner 15 is provided on the same side as the belt face 18*a* that faces downward with respect to the transporting direction, and comprises a cleaning blade 15*c* for eliminating the toner still remaining on the face of the image transferer 18 after secondary transfer operation, and a toner transport member 15*g* for transporting recovered toner. The cleaning blade 15*c* remains in contact with the image transferer 18 at the position where the image transferer 18 is passed around the driven roller 13. The primary transfer member 16 remains in contact with the back of the image transferer 18 while opposing the image carriers 17 of the respective image forming stations Y, M, C, and K, which will be described later. A transfer bias is applied to the primary transfer member 16.

The exposer W is provided in a space which is formed at an inclined lower position with reference to the obliquely-disposed image formation unit D. The sheet feeding unit 30 is provided at the bottom of the housing 10*a* and below the exposer W. The entire exposer W is housed in a case, and the case is provided in the space formed at an inclined lower position with reference to the belt face oriented downward in the transporting direction. In an optical system B, a single optical scanner 21 formed from a motor 21*a* and the rotary polygon mirror 21*b* is disposed horizontally on the bottom of the case, and laser beams, which are modulated by image signals of respective colors and originate from a plurality of laser light sources 23, are reflected by the polygon mirror 21*b*, to thus scan over the respective image carriers through deflection. A single f-θ lens 22 and a plurality of reflection mirrors 24 are provided in the optical system B such that scanning optical paths of respective colors are wrapped around not in parallel with the respective image carriers 17.

In the embodiment, the scanning optical system B is disposed in the lower portion of the device. Moreover, the optical scanner 21 is disposed on the bottom of the case. As a result, the vibration imparted to the entire case by the polygon mirror motor 21*a* is minimized. The number of polygon mirror motors 21, which are the vibration sources, is reduced to one, whereby the vibration imparted to the overall case is minimized. The respective image stations Y, M, C, and K are disposed in an oblique direction, and the image carriers 17 are disposed in parallel along the oblique arch-shaped line while being oriented upward. Toner storage containers 26 are disposed in inclined positions while being aligned in an oblique downward direction.

The sheet feeding unit 30 comprises a sheet feeding cassette 35 which stores recording media in a stacked manner, and a pickup roller 36 for feeding the recording medium in a one by one manner from the sheet feeding cassette 35. The sheet feeding unit 11 comprises a pair of gate rollers 37 for determining a timing at which the recording medium is to be fed to a secondary transfer section (one of the rollers is disposed in the housing 10*a*); the secondary transfer roller 39 serving as a secondary transferer which is brought into pressed contact with the drive roller 12 and the image transferer 18; a main sheet transporting path 38; the fuser 40; a pair of sheet ejecting rollers 41; and a sheet transporting path 42 for double-sided printing purpose.

In the embodiment, the fuser 40 can be provided in a space formed at an obliquely above position with reference to the belt face 18*b* oriented upwardly with respect to the transporting direction of the transfer belt. In other words, the fuser 40 can be provided in a space opposite the image forming station with reference to the transfer belt. Transfer of heat to the exposer W, the image transferer 18, and the image forming unit can be diminished, thereby lessening the frequency with which operation for compensating for color misregistration is to be performed. Particularly, the exposer W is located at a position most distant from the fuser 40, and the displacement induced by heat originating from components of the scanning optical system can be minimized, thereby preventing occurrence of color misregistration. Since the image transferer 18 is disposed in a direction inclined with respect to the drive roller 12, a wide space arises in the right side of the drawing, thereby enabling arrangement of the fuser 40. Thus, downsizing of the fusing device can be realized. Further, transfer of the heat originating from the fuser 40 to the exposer W, the image transferer 18, and the respective image forming stations Y, M, C, K, all of which are disposed on the left side of the device, can be prevented. The exposer W can be disposed in the lower left space of the image-forming unit D. Accordingly, vibration of the scanning optical system B of the exposer W, which would otherwise be caused by the vibration imparted to the housing 10*a* by the drive system of the image forming unit, can be minimized, thereby preventing deterioration of image quality.

In the embodiment, the intermediate transfer belt is configured to contact the image carriers 17 as the image transferer 18. A sheet medium transfer belt, which transports a sheet medium while the sheet medium is attached on a face of the belt by suction and which sequentially transfers toner images on the face of the sheet medium in an overlapping manner to thus form an image, may be configured to contact the image carriers 17 as the image transferer 18. In this case, a difference between this alternate configuration and the above-described respective embodiments lies in that the transporting direction of the sheet medium transport belt, which is the image transferer 18, is oriented in an opposite direction; that is, an upward direction, at the lower face which comes into contact with the image carriers 17.

The embodiments of the present invention have been described thus far. However, the present invention is not limited to these embodiments and is susceptible to various modifications. For instance, although according to the above-described embodiment, the spring is disposed between the belt stretching member and the nip pressing member so that the tension is imparted to the heat-resistant belt by the belt stretching member and the nip pressing member is lightly pressed to the pressing roller by the reaction force, the respectives may be constituted to be urged by the springs separately from each other. Further, the guide portion which is composed of the flange of the nip pressing member may be provided to any one of these members with a structure in which the belt stretching member and the nip pressing member are supported and urged by the spring. Further, although the sliding members substantially in the shape of the half moon is used as the belt stretching member, the belt stretching member may be constituted by using a single or a plurality of stretching rollers. For example, there may be constructed a constitution of adding the nip pressing member of the embodiment, between the belt stretching member and the pressing roller using the sliding member or the roller member of the fusing unit proposed in, for example, JP-A-2004-4234, or the nip pressing member may be similarly disposed on the upstream side of the pressing nip by the pressing roller and the heating roller in the fusing unit having the constitution of the related art also including other fusing unit which is not interposed with the heat-resistant belt.

What is claimed is:

1. A fusing unit for fusing a nonfused toner image formed on a sheet medium, comprising:

a heating roller;

a pressing roller pressed to the heating roller;

a heat-resistant belt which is wrapped around an outer periphery of the pressing roller and travels while being nipped at a nip portion between the pressing roller and the heating roller;

a belt stretching member which stretches the heat-resistant belt; and a sliding member which is disposed between the belt stretching member and the pressing roller and slides along the outer periphery of the pressing roller, wherein the sliding member is disposed to be brought into contact with the heating roller through the heat-resistant belt at a contact portion, and wherein the belt stretching member comprises a pressing portion that presses the sliding member in the direction of the heating roller on a back side of the contact portion of the sliding member.

2. The fusing unit according to claim 1, wherein the belt stretching member and the sliding member are disposed to be brought into contact with the heating roller at each contact portion through the heat-resistant belt.

3. The fusing unit according to claim 2, wherein the contact portion of the belt stretching member has a flat face.

4. The fusing unit according to claim 2, wherein the contact portion of the sliding member has a curved face corresponding to a radius of curvature of the heating roller.

5. The fusing unit according to claim 2, wherein the sliding member is integrally formed on the side of the nip portion and has a notched portion on the opposite side to the nip portion.

6. The fusing unit according to claim 2, wherein the fusing unit further comprises an urging member that urges the sliding member in the direction of the heating roller.

7. The fusing unit according to claim 2, wherein the fusing unit further comprises an urging member that urges the belt stretching member in the direction of the heating roller.

8. An image forming apparatus comprising the fusing unit according to claim 2 mounted thereon.

9. The fusing unit according to claim 1, wherein the belt stretching member is disposed at a position where the sheet medium is guided to the nip portion to be brought in noncontact with the heating roller through the heat-resistant belt when the sheet medium goes into the nip portion.

10. The fusing unit according to claim 9, wherein the contact portion of the sliding member has a curved face corresponding to a radius of curvature of the heating roller.

11. The fusing unit according to claim 9, wherein the sliding member is integrally formed on the side of the nip portion and is provided with a notched portion on the opposite side to the nip portion.

12. The fusing unit according to claim 9, wherein the fusing unit further comprises an urging member that urges the sliding member in the direction of the heating roller.

13. The fusing unit according to claim 9, the fusing unit further comprises an urging member that urges the belt stretching member in the direction of the heating roller.

14. An image forming apparatus comprising the fusing unit according to claim 9 mounted thereon.

15. The fusing unit according to claim 1, wherein the pressing portion comprises an integral wall and a plurality of projected portions on the integral wall.

16. A fusing unit for fusing a nonfused toner image formed on a sheet medium, comprising:

a heating roller;

a pressing roller pressed to the heating roller;

a heat-resistant belt which is wrapped around an outer periphery of the pressing roller and travels while being nipped at a nip portion between the pressing roller and the heating roller;

a belt stretching member which stretches the heat-resistant belt; and a sliding member which is disposed between the belt stretching member and the pressing roller and slides along the outer periphery of the pressing roller, wherein the sliding member is disposed to be brought into contact with the heating roller through the heat-resistant belt at a contact portion, wherein the belt stretching member and the sliding member are disposed to be brought into contact with the heating roller at each contact portion through the heat-resistant belt, and wherein the belt stretching member is pivotably supported at the side of the heating roller with an edge portion on the back side of the sliding member as a supporting point.

17. A fusing unit for fusing a nonfused toner image formed on a sheet medium, comprising:

a heating roller;

a pressing roller pressed to the heating roller;

a heat-resistant belt which is wrapped around an outer periphery of the pressing roller and travels while being nipped at a nip portion between the pressing roller and the heating roller;

a belt stretching member which stretches the heat-resistant belt; and a sliding member which is disposed between the belt stretching member and the pressing roller and slides along the outer periphery of the pressing roller, wherein the sliding member is disposed to be brought into contact with the heating roller through the heat-resistant belt at a contact portion, wherein the belt stretching member and the sliding member are disposed to be brought into contact with the heating roller at each contact portion through the heat-resistant belt, and wherein the belt stretching member comprises a plurality of slits orthogonal to the axial direction at a portion except the contact portion thereof.

18. A fusing unit for fusing a nonfused toner image formed on a sheet medium, comprising:

a heating roller;

a pressing roller pressed to the heating roller;

a heat-resistant belt which is wrapped around an outer periphery of the pressing roller and travels while being pinned at a nip portion between the pressing roller and the heating roller;

a belt stretching member which stretches the heat-resistant belt; and a sliding member which is disposed between the belt stretching member and the pressing roller and slides along the outer periphery of the pressing roller, wherein the sliding member is disposed to be brought into contact with the heating roller though the heat-resistant belt at a contact portion, wherein the belt stretching member and the sliding member are disposed to be brought into contact with the heating roller at each contact portion through the heat-resistant belt, and wherein the sliding member comprises a sliding portion which slides along the outer periphery of the pressing roller, the sliding portion having: a plurality of projected portions in the shape of a circular arc which is formed along the outer periphery of the pressing roller and disposed in the axial direction; and a sliding face integrally formed continuously in the axial direction at a front end on the side of the nip portion.

19. A fusing unit for fusing a nonfused toner image formed on a sheet medium, comprising:

a heating roller;

a pressing roller pressed to the heating roller;

a heat-resistant belt which is wrapped around an outer periphery of the pressing roller and travels while being nipped at a nip portion between the pressing roller and the heating roller;

a belt stretching member which stretches the heat-resistant belt; and a sliding member which is disposed between the belt stretching member and the pressing roller and slides along the outer periphery of the pressing roller, wherein the sliding member is disposed to be brought into contact with the heating roller though the heat-resistant belt at a contact portion, wherein the belt stretching member and the sliding member are disposed to be brought into contact with the heating roller at each contact portion through the heat-resistant belt, and wherein the sliding member has a front end in a wedge-like shape to bite the nip portion by a friction force generated with rotation of the pressing roller.

20. A fusing unit for fusing a nonfused toner image formed on a sheet medium, comprising:

a heating roller;

a pressing roller pressed to the heating roller;

a heat-resistant belt which is wrapped around an outer periphery of the pressing roller and travels while being nipped at a nip portion between the pressing roller and the heating roller;

a belt stretching member which stretches the heat-resistant belt;

a sliding member which is disposed between the belt stretching member and the pressing roller and slides along the outer periphery of the pressing roller; and an urging member between the sliding member and the belt stretching member which urges the belt stretching member in a stretching direction by applying a tension to the heat-resistant belt while pressing the sliding member to the outer periphery of the pressing roller;

wherein the sliding member is disposed to be brought into contact with the heating roller through the heat-resistant belt at a contact portion, and wherein the belt stretching member and the sliding member are disposed to be brought into contact with the heating roller at each contact portion through the heat-resistant belt.

21. The fusing unit according to claim 20, wherein a plurality of pieces of the urging member are disposed in the axial direction at a predetermined interval.

22. A fusing unit for fusing a nonfused toner image formed on a sheet medium, comprising:

a heating roller;

a pressing roller pressed to the heating roller;

a heat-resistant belt which is wrapped around an outer periphery of the pressing roller and travels while being nipped at a nip portion between the pressing roller and the heating roller;

a belt stretching member which stretches the heat-resistant belt; and a sliding member which is disposed between the belt stretching member and the pressing roller and slides along the outer periphery of the pressing roller, wherein the sliding member is disposed to be brought into contact with the heating roller through the heat-resistant belt at a contact portion, wherein the belt stretching member is disposed at a position where the sheet medium is guided to the nip portion to be brought in noncontact with the heating roller through the heat-resistant belt when the sheet medium goes into the nip portion, and wherein the sliding member comprises a sliding portion which slides along the outer periphery of the pressing roller, the sliding portion having: a plurality of projected portions in the shape of a circular arc which is formed along the outer periphery of the pressing roller and disposed in the axial direction; and a sliding face integrally formed continuously in the axial direction at a front end on the side of the nip portion.

23. A fusing unit for fusing a nonfused toner image formed on a sheet medium, comprising:

a heating roller;

a pressing roller pressed to the heating roller;

a heat-resistant belt which is wrapped around an outer periphery of the pressing roller and travels while being nipped at a nip portion between the pressing roller and the heating roller;

a belt stretching member which stretches the heat-resistant belt; and a sliding member which is disposed between the belt stretching member and the pressing roller and slides along the outer periphery of the pressing roller, wherein the sliding member is disposed to be brought into contact with the heating roller though the heat-resistant belt at a contact portion, wherein the belt stretching member is disposed at a position where the sheet medium is guided to the nip portion to be brought in noncontact with the heating roller through the heat-resistant belt when the sheet medium goes into the nip portion, and wherein the sliding member has a front end in a wedge-like shape to bite the nip portion by a friction force generated with rotation of the pressing roller.

24. A fusing unit for fusing a nonfused toner image formed on a sheet medium, comprising:

a heating roller;

a pressing roller pressed to the heating roller;

a heat-resistant belt which is wrapped around an outer periphery of the pressing roller and travels while being nipped at a nip portion between the pressing roller and the heating roller;

a belt stretching member which stretches the heat-resistant belt;

a sliding member which is disposed between the belt stretching member and the pressing roller and slides alone the outer periphery of the pressing roller; and an urging member between the sliding member and the belt stretching member which urges the belt stretching member in a stretching direction by applying a tension to the heat-resistant belt while pressing the sliding member to the outer periphery of the pressing roller, wherein the sliding member is disposed to be brought into contact with the heating roller through the heat-resistant belt at a contact portion, and wherein the belt stretching member is disposed at a position where the sheet medium is guided to the nip portion to be brought in noncontact with the heating roller through the heat-resistant belt when the sheet medium goes into the nip portion.

25. The fusing unit according to claim 24, wherein a plurality of pieces of the urging member are disposed in the axial direction at a predetermined interval.

* * * * *